US006915807B2

(12) United States Patent
Choi

(10) Patent No.: US 6,915,807 B2
(45) Date of Patent: Jul. 12, 2005

(54) HAIR SETTING DEVICE

(75) Inventor: Young Sik Choi, Dongbu Apt. 105-602,757-3 Wolgye-dong, Gwangsan-gu, Gwangju (KR), 506-769

(73) Assignee: Young Sik Choi, Gyeonggi-do (KR)

( * ) Notice: Subject to any disclaimer, the term of this patent is extended or adjusted under 35 U.S.C. 154(b) by 247 days.

(21) Appl. No.: 10/203,648

(22) PCT Filed: Feb. 23, 2001

(86) PCT No.: PCT/KR01/00271

§ 371 (c)(1),
(2), (4) Date: Aug. 23, 2002

(87) PCT Pub. No.: WO01/62118

PCT Pub. Date: Aug. 30, 2001

(65) Prior Publication Data

US 2003/0029468 A1 Feb. 13, 2003

(30) Foreign Application Priority Data

| | | |
|---|---|---|
| Feb. 23, 2000 | (KR) | 2000-08658 |
| Mar. 20, 2000 | (KR) | 2000-13970 |
| Apr. 28, 2000 | (KR) | 2000-22873 |
| Jul. 12, 2000 | (KR) | 2000-39938 |
| Jul. 12, 2000 | (KR) | 2000-39939 |
| Jul. 12, 2000 | (KR) | 2000-39940 |

(51) Int. Cl.[7] ..... A45D 24/22
(52) U.S. Cl. ..... 132/116; 132/115; 132/112
(58) Field of Search ..... 132/112, 219, 132/108, 109, 111, 115, 119.1, 116; 137/861, 39

(56) References Cited

U.S. PATENT DOCUMENTS

| | | | | | |
|---|---|---|---|---|---|
| 2,381,048 A | * | 8/1945 | Habostad | 132/113 |
| 2,609,821 A | * | 9/1952 | Weissberger | 132/110 |
| 3,861,407 A | * | 1/1975 | Gabriele | 132/108 |
| 3,863,650 A | * | 2/1975 | De Maria | 132/212 |
| 4,055,195 A | * | 10/1977 | Moses | 132/115 |
| 5,325,878 A | * | 7/1994 | McKay | 132/116 |
| 6,588,433 B2 | * | 7/2003 | Asano | 132/116 |

FOREIGN PATENT DOCUMENTS

| | | | | |
|---|---|---|---|---|
| GB | 2006619 A | * | 5/1979 | A45D/24/30 |
| JP | 50-97685 U | | 8/1975 | |
| JP | 52-85695 U | | 6/1977 | |
| JP | 55-58102 U | | 4/1980 | |
| JP | 56-14508 U | | 2/1981 | |
| JP | 62-128442 U | | 8/1987 | |
| JP | 63-125906 U | | 8/1988 | |

* cited by examiner

*Primary Examiner*—John J. Wilson
*Assistant Examiner*—Robyn Doan
(74) *Attorney, Agent, or Firm*—Bacon & Thomas PLLC

(57) ABSTRACT

A hair setting device comprises a setting material supply for storing hair setting material, a hollow pipe-shaped body including a guide groove formed along a lengthwise direction of the body and a slit formed at a bottom of the guide groove, the slit communicating with an inside space of the hollow pipe-shaped body, a base for fixing the hollow pipe-shaped body to the setting material supply, the base communicating with the inside space of the hollow pipe-shaped body and including an inner surface enclosing a nozzle of the setting material supply, an operating valve, including a setting material guide hole at a center portion of the operating valve, the operating valve being supported by a first spring inside the hollow pipe-shaped body, a bottom end portion of the operating valve being in contact with the nozzle of the setting material supply, a push button installed at a bottom portion of the hollow pipe-shape body in a radial direction thereof and supported by a second spring, wherein the push button is in contact with the operating valve in such a way that the operating valve is moved toward the nozzle of the setting material supply when the push button is pressed, and a comb including a base portion which is detachably engaged with the guide groove of the body and a plurality of outlets arranged in a regular interval for allowing the hair setting material to come out from the slit.

27 Claims, 30 Drawing Sheets

HAIR SETTING DEVICE

FIELD OF THE INVENTION

Figure 1:
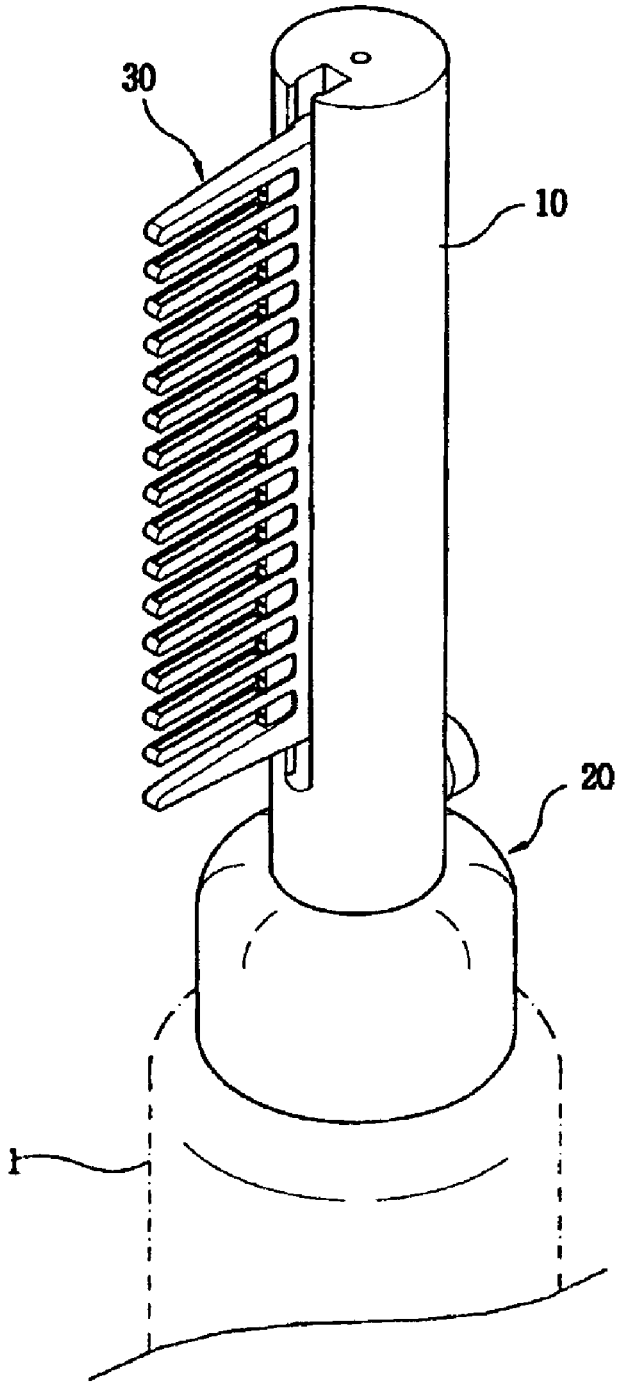

The present invention relates to a hair setting device for setting hair to have a desired shape; and, more particularly, to a hair setting device for setting a desired hair style just by combing one's hair without having one's hand stained with hair setting material such as mousse

BACKGROUND OF THE INVENTION

Conventionally, in order to make a desired hair style, one uses a hair dryer to make his or her hair half-dried and then fixes the hair by using hair setting material such as a hair spray, hair gel or mousse.

The hair spray is used directly onto the one's hair to fix a hair style which is already in a desired shape. On the contrary, the hair gel or mousse is used to make a desired hair style while they are still wet and then dried to fix the style.

Among these hair setting materials, the mousse is a viscous fluid generally filled in a container with air and, since the mousse dries fast and is easy to use, it is getting popular. When one uses the mousse to set one's hair style, a required amount of the mousse is discharged out of the container onto a comb or hand. However, the comb usually does not have enough area to accommodate the required amount of the mousse. Further, in case one uses one's hand, he or she has to wash his or her hand to remove the remaining mousse on the hand.

SUMMARY OF THE INVENTION

It is, therefore, an object of the present invention to provide a hair setting device for setting hair in a desired shape just by combing one's hair without having one's hand stained with hair setting material such as mousse, hair gel or hair spray.

It is, therefore, another object of the present invention to provide a hair setting device including a comb which has a teeth length adjusting means so that the hair setting device has various uses without changing the comb.

It is, therefore, a third object of the present invention to provide a hair setting device comprising a comb which can prevent the mousse from being flown down along the teeth thereof and make mousse applied to hair uniformly.

It is, therefore, a fourth object of the present invention to provide a hair setting device comprising a separated hair setting material supply so that one can make one's hair style without holding a mousse container in one's hand.

It is, therefore, a fifth object of the present invention to provide a hair setting device comprising a mousse/hair-spray supplying device which allows one to make one's hair style without holding a mousse/hair-spray container in one's hand and make the hair spray discharged uniformly.

It is, therefore, a sixth object of the present invention to provide a hair setting device comprising a motor pump for conveying the mousse or hair spray from a container to a comb through a hose or tube.

It is, therefore, a seventh object of the present invention to provide a hair setting device which can control a flow amount of a hair setting material according to the characteristics of user's hair.

In accordance with an aspect of the present invention, there is provided a hair setting device for setting hair to have a desired shape, comprising:

a setting material supply for storing hair setting material;

a hollow pipe-shaped body including a guide groove formed along a lengthwise direction of the body and a slit formed at a bottom of the guide groove, the slit communicating with an inside space of the hollow pipe-shaped body;

a base for fixing the hollow pipe-shaped body to the setting material supply, the base communicating with the inside space of the hollow pipe-shaped body and including an inner surface enclosing a nozzle of the setting material supply;

an operating valve including a setting material guide hole at a center portion of the operating valve, the operating valve being supported by a first spring inside the hollow pipe-shaped body, a bottom end portion of the operating valve being in contact with the nozzle of the setting material supply;

a push button installed at a bottom portion of the hollow pipe-shaped body in a radial direction thereof and supported by a second spring, wherein the push button is in contact with the operating valve in such a way that the operating valve is moved toward the nozzle of the setting material supply when the push button is pressed; and a comb including a base portion which is detachably engaged with the guide groove of the body and a plurality of outlets arranged in a regular interval for allowing the hair setting material to come out from the slit.

In accordance with another aspect of the present invention, there is provided a hair setting device comprising:

a hollow pipe-shaped body including a passage formed inside thereof, a guide groove formed along a lengthwise direction of the body, and a slit formed at a bottom of the guide groove and communicating with the passage;

a base provided at a bottom portion of the body for fixing the hollow pipe-shaped body to a setting material supply; and a comb including a base portion having a plurality of outlets formed in a regular interval, the base portion being detachably engaged with the guide groove, wherein the comb further includes engaging protrusions provided at both sides thereof and a rectangular-shaped control bar surrounding teeth of the comb, the rectangular-shaped control bar having positioning protrusions on the inner surface thereof, whereby lengths of the teeth can be adjusted by changing a position where the engaging protrusions engages with the positioning protrusions.

In accordance with a third aspect of the present invention, there is provided a hair setting device comprising:

a hollow pipe-shaped body including a passage formed inside thereof, a guide groove formed along a lengthwise direction of the body, and a slit formed at a bottom of the guide groove and communicating with the passage;

a base provided at a bottom portion of the body for fixing the hollow pipe-shaped body to a setting material supply; and a comb including a base portion having a plurality of outlets formed in a regular interval, the base portion being detachably engaged with the guide groove, wherein the comb further includes a control bar inserting slit having a predetermined depth from end portions of teeth of the comb and dividing the teeth into two parts, a control bar inserted into the control bar inserting slit, the control bar inserting slit having engaging protrusions on both inner side surfaces thereof and the control bar having positioning protrusions on both side surfaces thereof, whereby lengths of the teeth can be adjusted by changing a position where the engaging protrusions engage with the positioning protrusions.

In accordance with a forth aspect of the present invention, there is provided a comb for using in a hair setting device which comprises a setting material supply containing setting material and a grip portion engaging with the setting material supply directly or through a tube, the comb comprising:

a reserving space provided in a base portion of the comb for reserving setting material conveyed from the setting material supply;

a plurality of discharging holes extending from the reserving space to areas between teeth of the comb or from the reserving space through each tooth of the comb to the side surface of said tooth; and an absorption member provided among teeth of the comb for absorbing the setting material discharged from discharging holes.

In accordance with a fifth aspect of the present invention, there is provided a hair setting device comprising:

a hollow pipe-shaped body including a setting material passage formed inside thereof, a guide groove formed along a lengthwise direction of the body, and a slit formed at a bottom of the guide groove and communicating with the passage;

an operating valve installed at a bottom portion of the setting material passage, the operating valve including a through-hole through which setting material flows;

a push button provided at a bottom portion of the body in a radial direction, the push button being supported by a spring and in contact with an inclined surface of the operating valve in such a way that the operating valve move downwards when the push button is pressed;

a comb including a base portion detachably engaged with the guide groove and a plurality of discharging holes disposed in a regular interval on the base portion;

a valve housing attached to a bottom portion of the body, the valve housing including an upper inner area and a lower inner area into which setting material flows, the upper inner area communicating with the lower inner area;

a discharging valve provided in the upper inner area of the valve housing, the discharging nozzle including an end portion being in contact with the operating valve in such a way that the discharging valve can move in a vertical direction by the operation of the operating valve;

an adjustable valve disposed below the discharging valve, the adjustable valve being positioned by the discharging valve, wherein an entrance area between the upper inner area and the lower inner area is changed according to the position of the adjustable valve;

a baffle plate provided at a bottom of the valve housing for closing the lower inner area, the baffle plate having setting material inlet;

a spring disposed between the adjustable valve and the baffle plate for supporting the adjustable valve;

a hose including an end portion which is connected to the inlet of the baffle plate;

a motor pump to which the other end portion of the hose is connected; and a setting material conveying passage connecting the motor pump to the setting material supply.

In accordance with a sixth aspect of the present invention, there is provided a hair setting material supplying device, comprising:

a setting material supply including a nozzle;

a hollow pipe-shaped grip member including a setting material passage, a valve button provided for opening and closing the setting material passage, a guide groove formed in a lengthwise direction of the grip member and a slit which is provided on an inner surface of the guide groove and communicating with the setting material passage;

a tube for connecting the hollow pipe-shaped grip member to the nozzle of the setting material supply;

a fixing member for fixing the tube to the nozzle and operating selectively to press the nozzle; and a comb including a base portion detachably engaged with the guide groove and a plurality of discharging holes.

In accordance with a seventh aspect of the present invention, there is provided a hair setting device, comprising:

a setting material supplying unit containing hair setting material and having a motor pump;

a hollow pipe-shaped grip member including a setting material passage, a valve button for opening and closing the setting material passage, a guide groove formed in a lengthwise direction of the grip member and a slit which is formed on an inner surface of the guide groove and communicating with the setting material passage; and a comb including a base portion detachably engaging with the guide groove and a plurality of discharging holes provided on the base portion.

In accordance with an eighth aspect of the present invention, there is provided a hair setting device, comprising:

a comb;

a body including a hair setting material passage;

a setting material supply for supplying hair setting material to the body;

a setting material supplying button which includes a ring-shaped passage for opening and closing the setting material passage; and an adjusting means for adjusting the amount of the setting material flowing through the hair setting material passage.

BRIEF DESCRIPTION OF THE INVENTION

Figure 2:
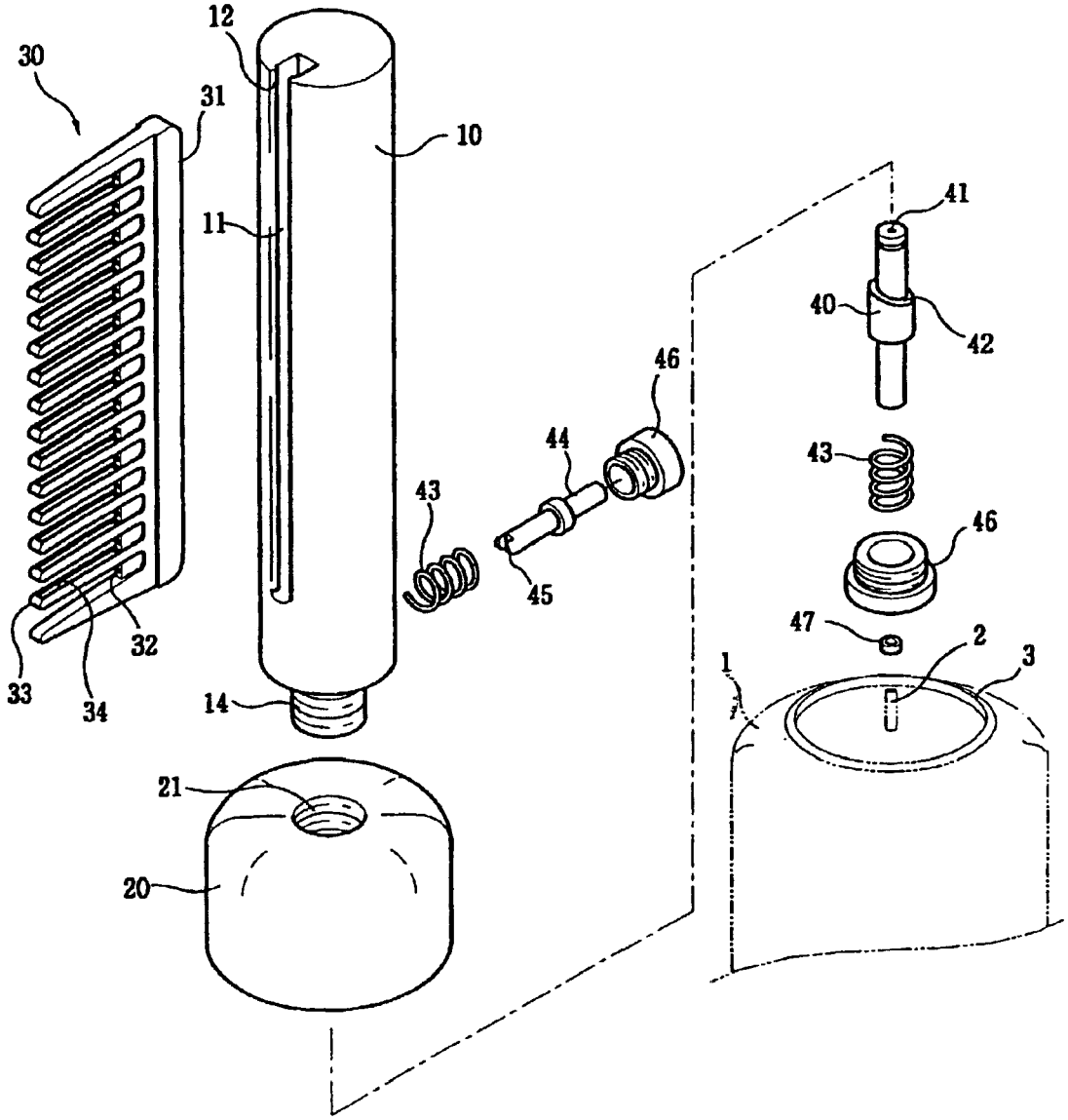
Figure 3:
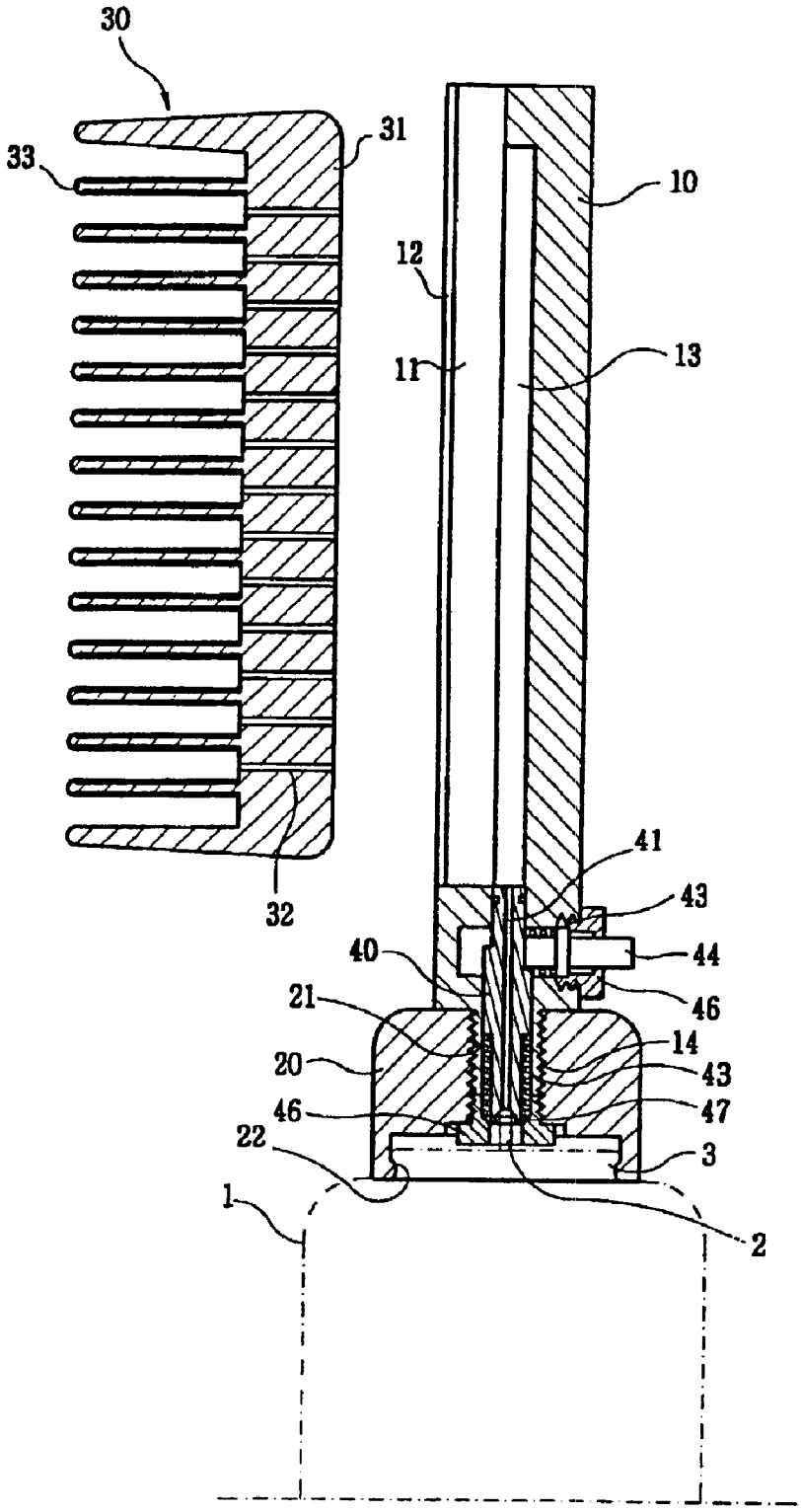
Figure 4A:
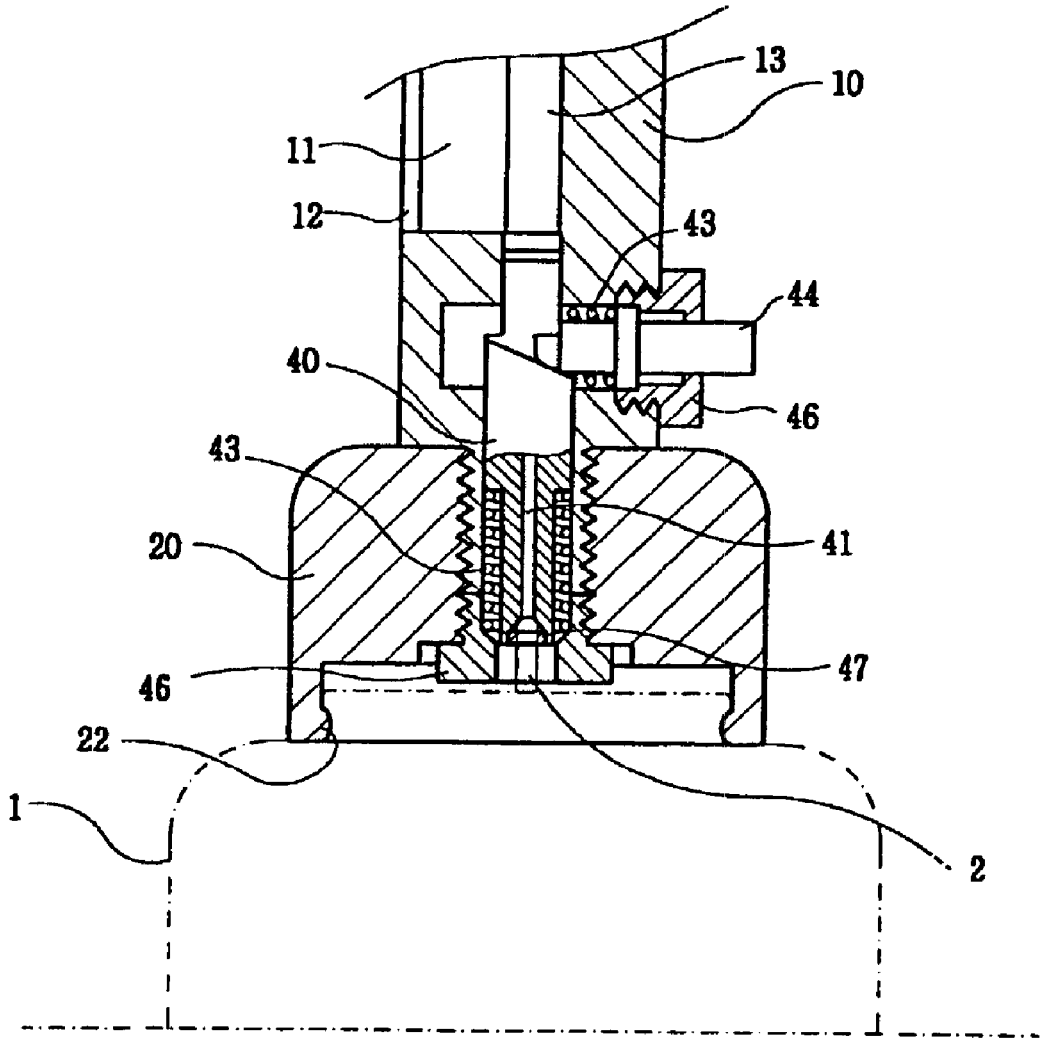
Figure 4B:
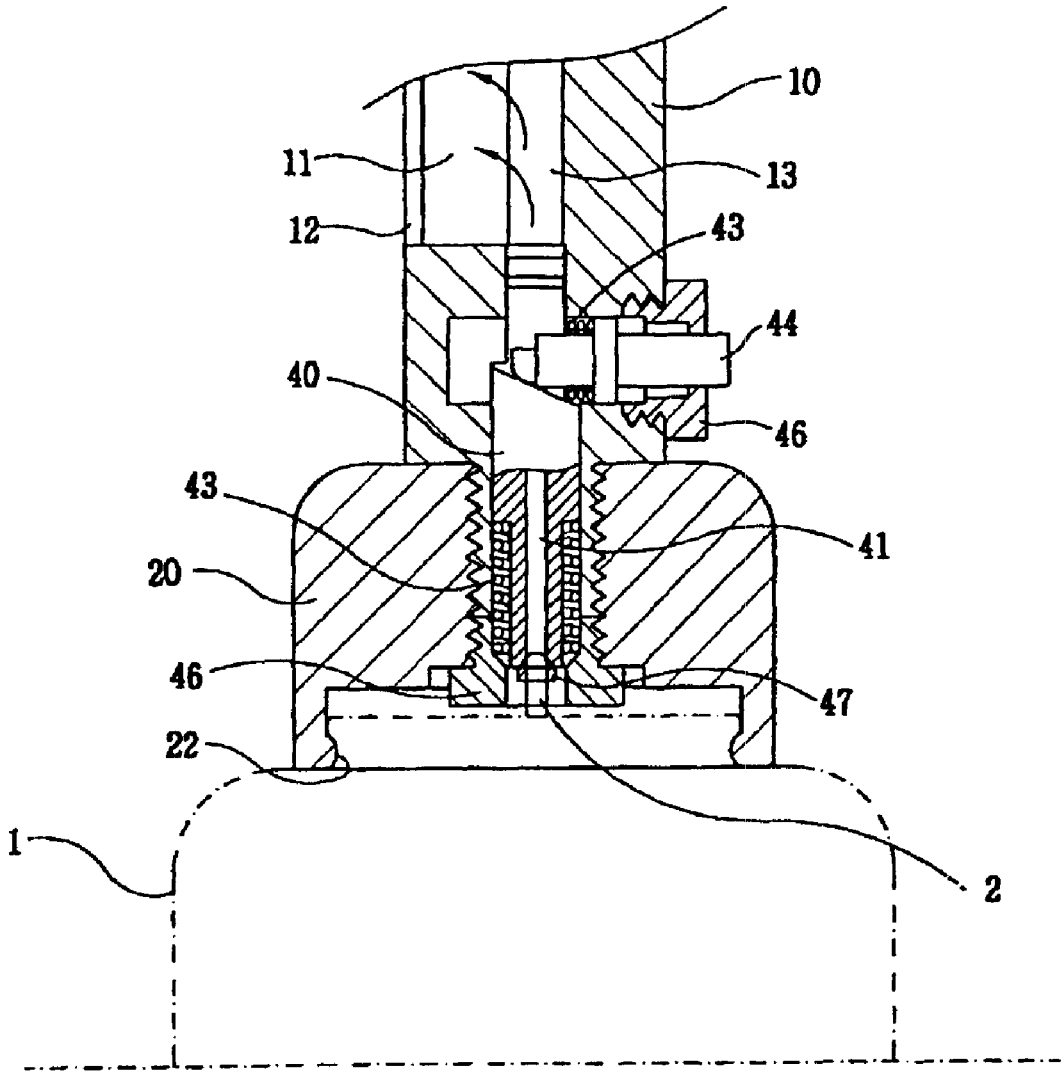
Figure 5:
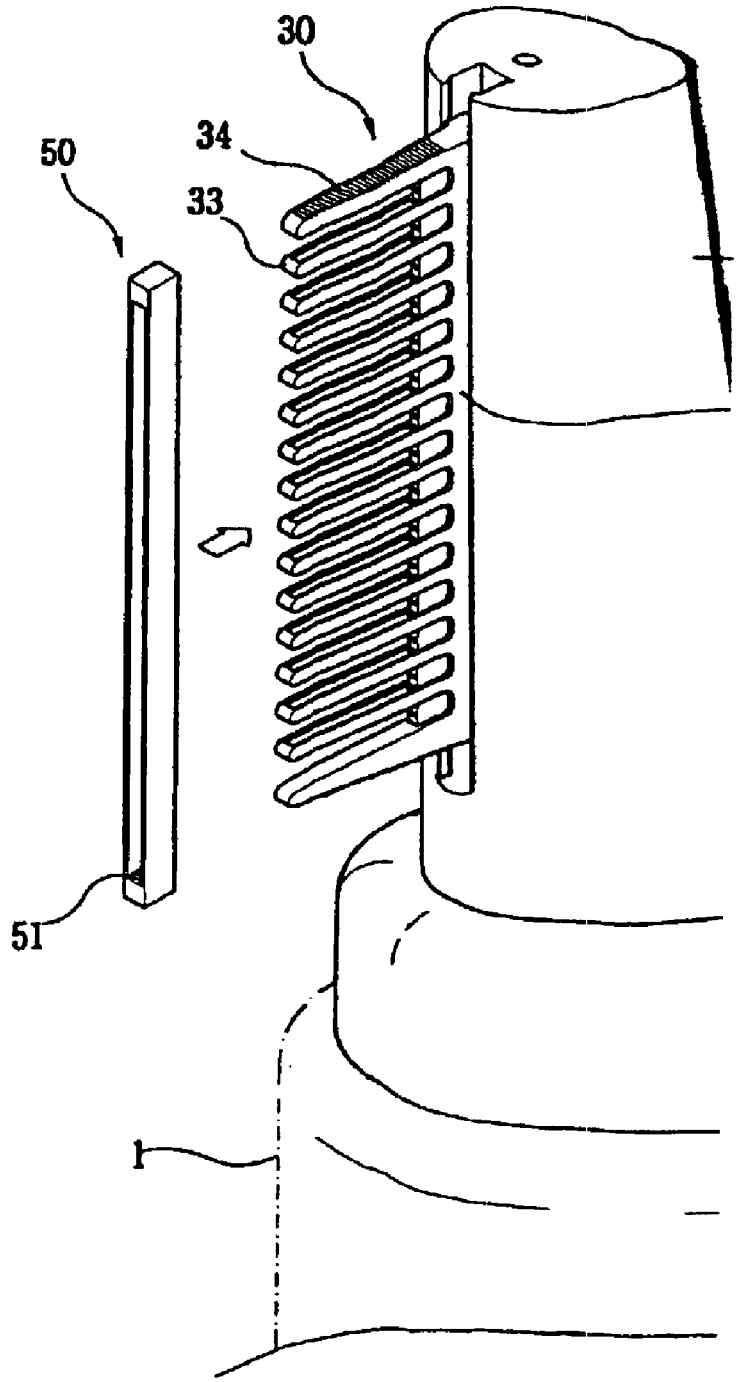
Figure 6:
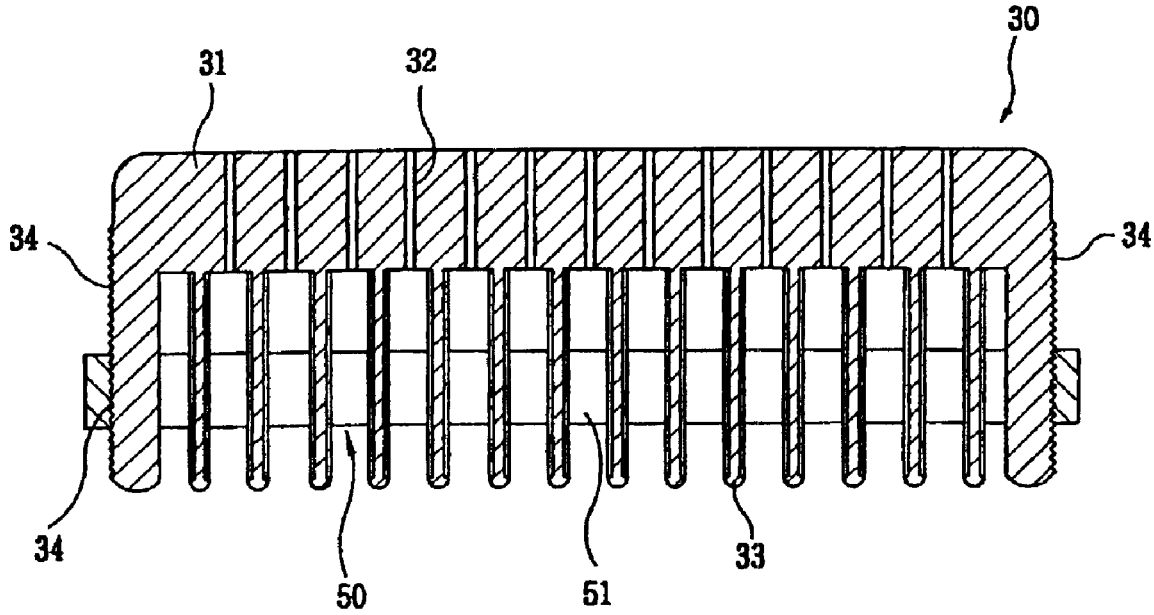
Figure 7:
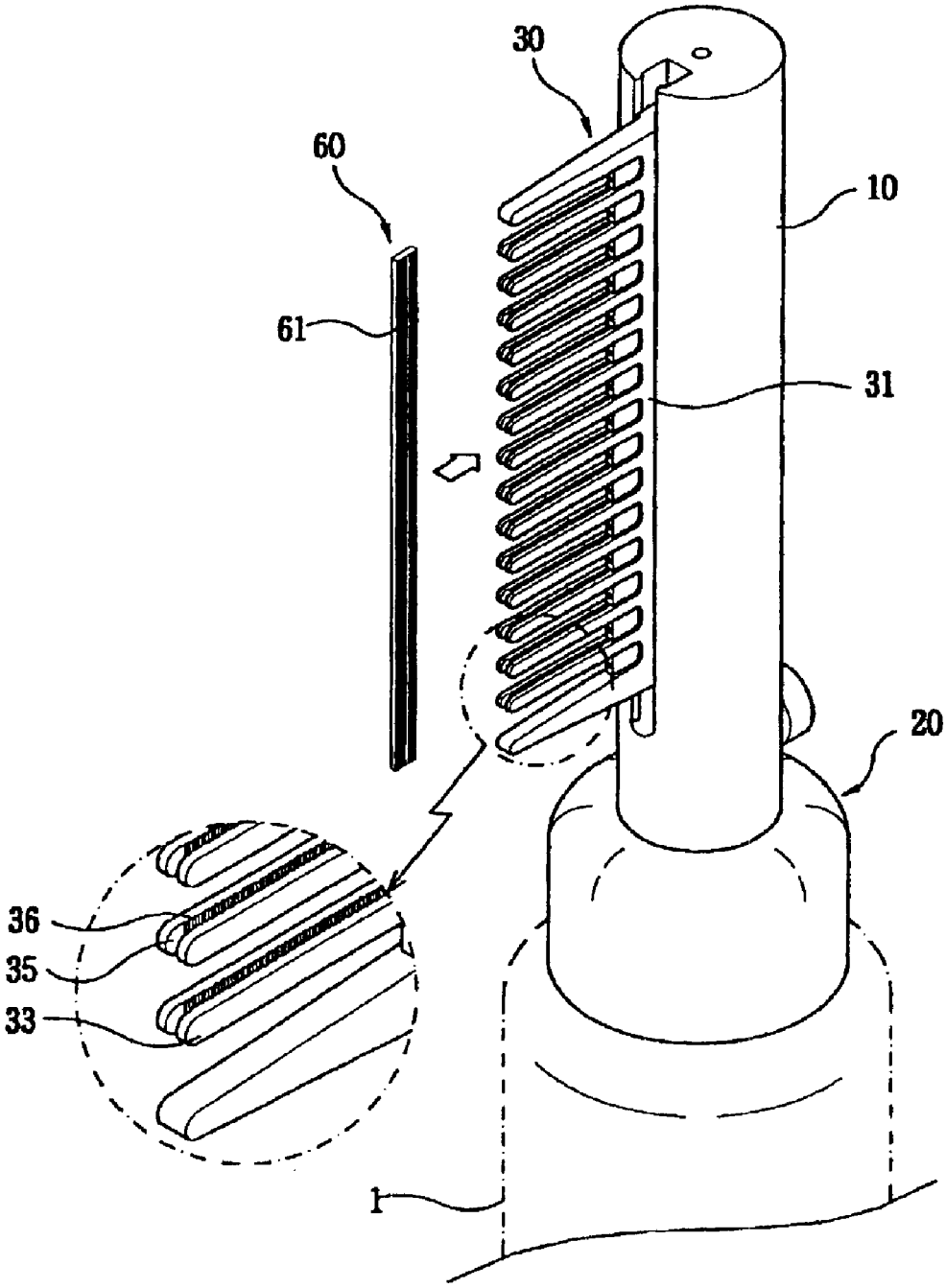
Figure 8:
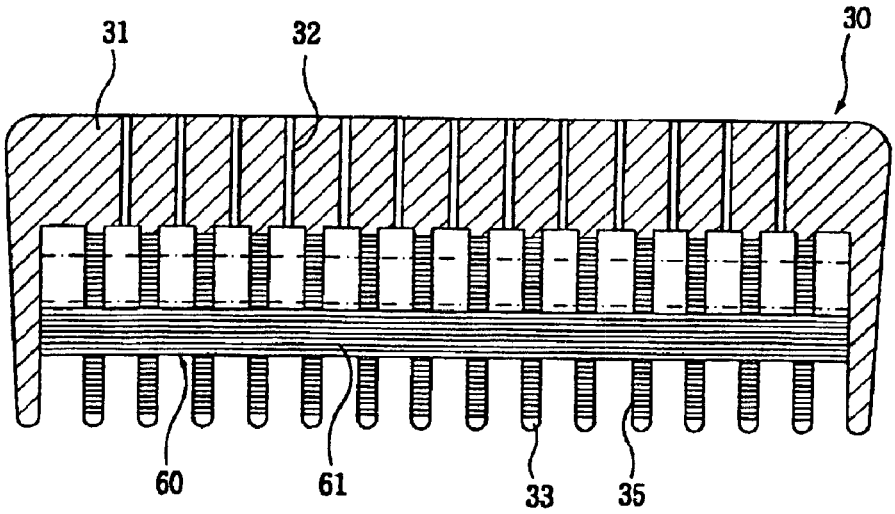
Figure 9:
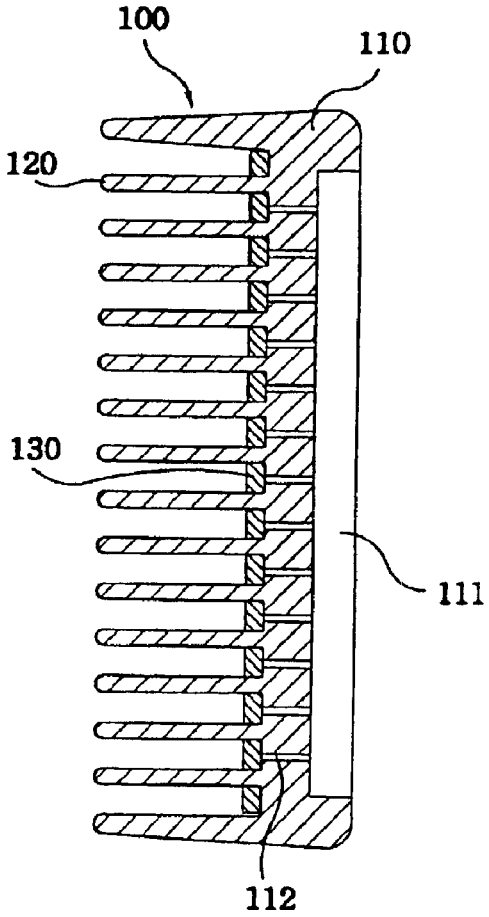
Figure 10:
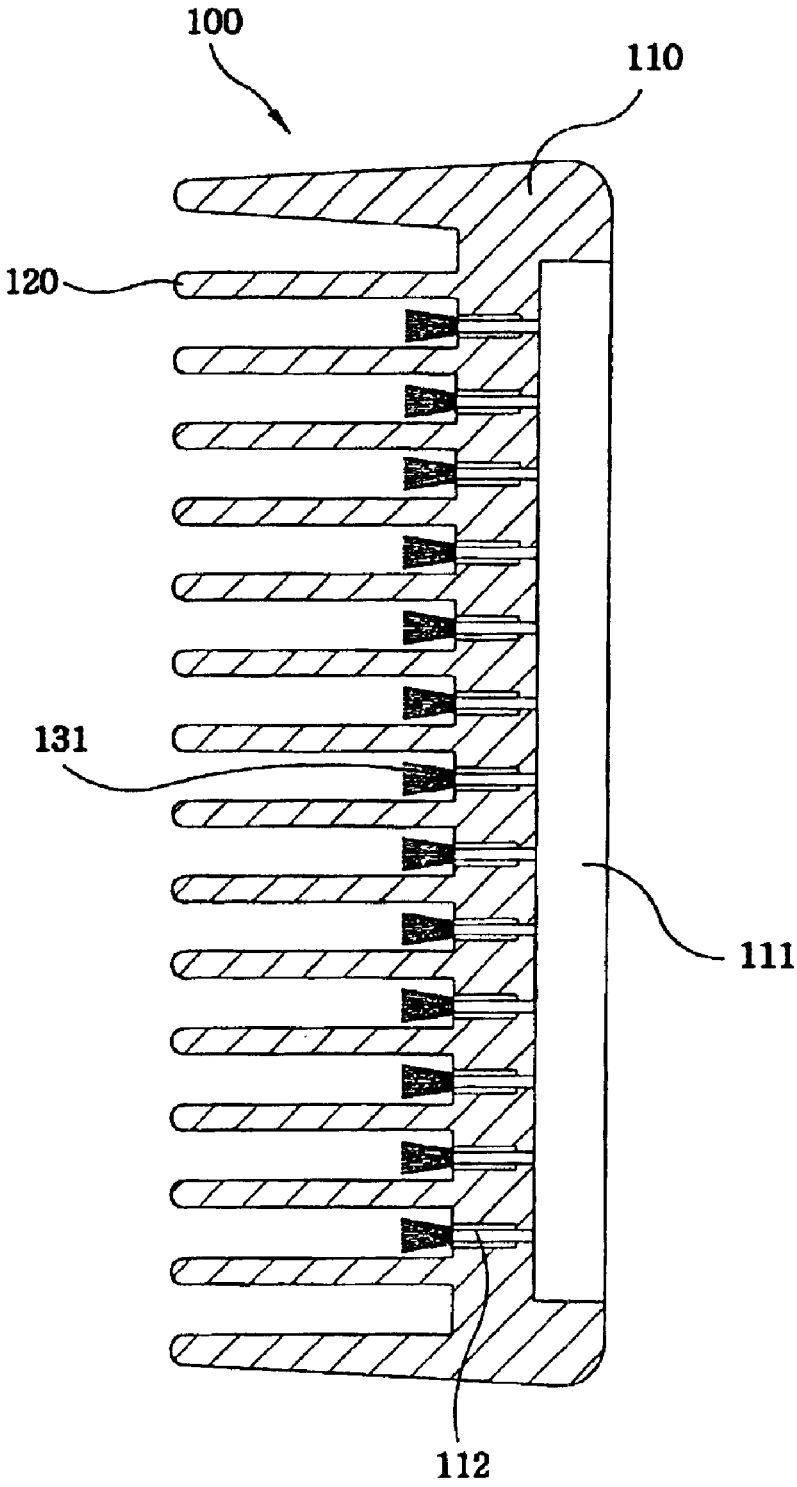
Figure 11:
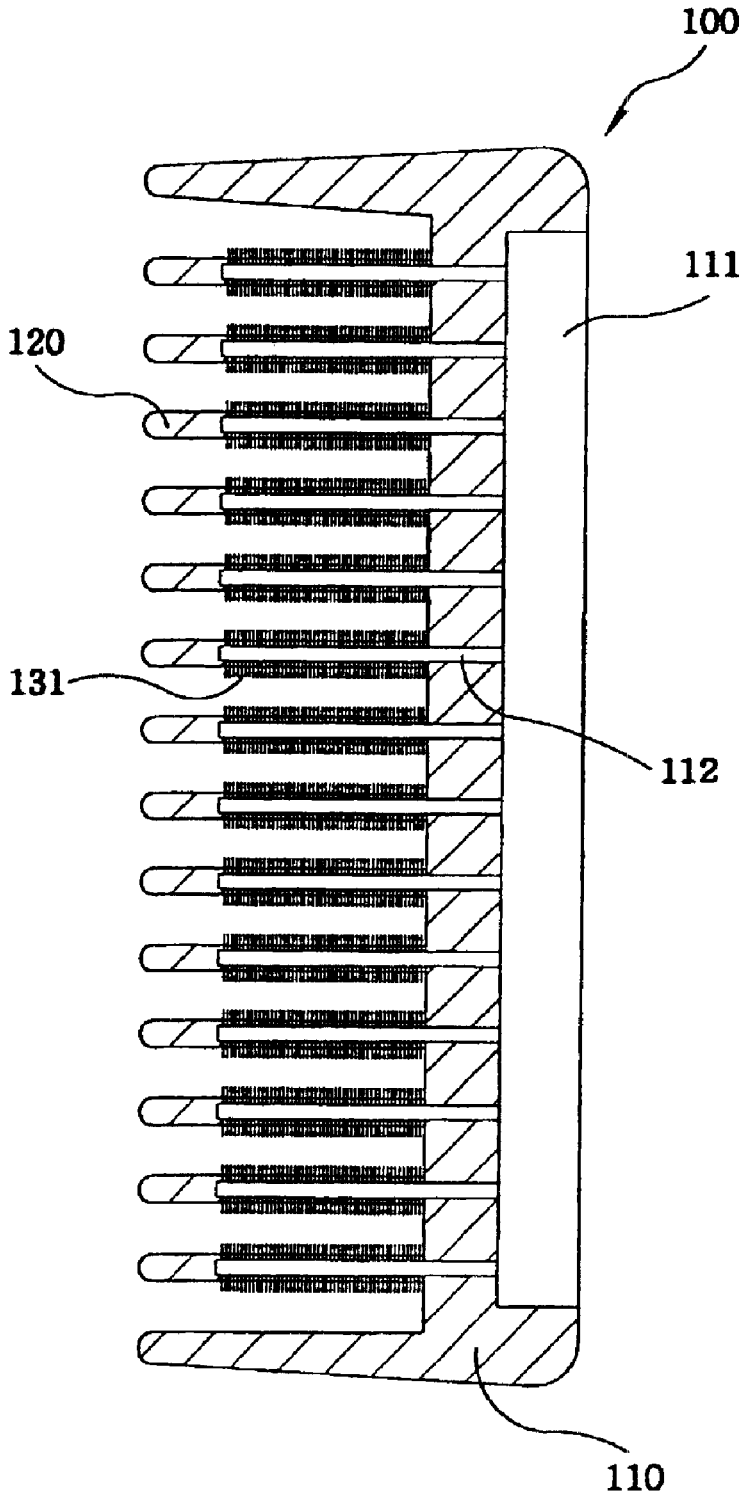
Figure 12:
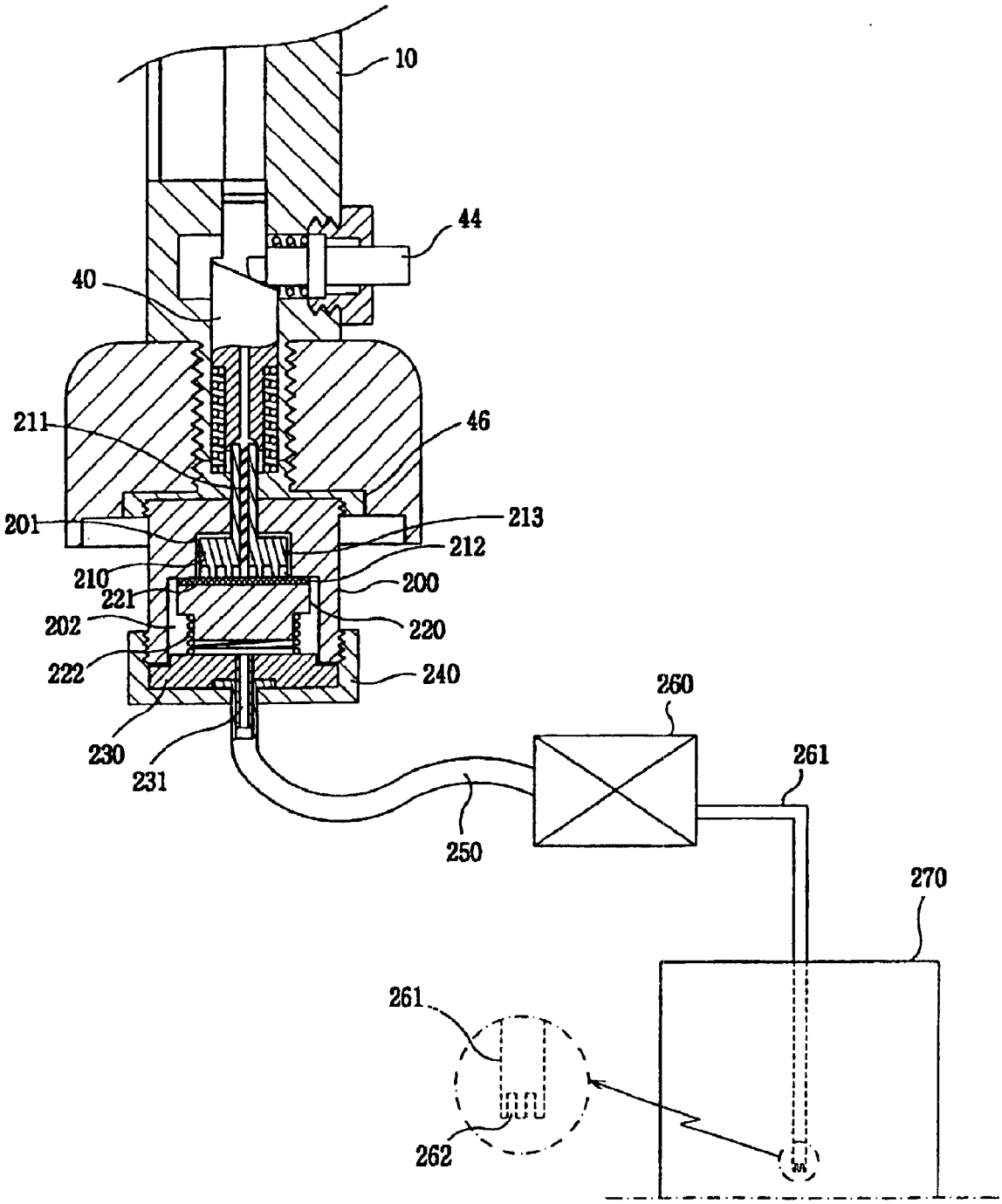
Figure 13:
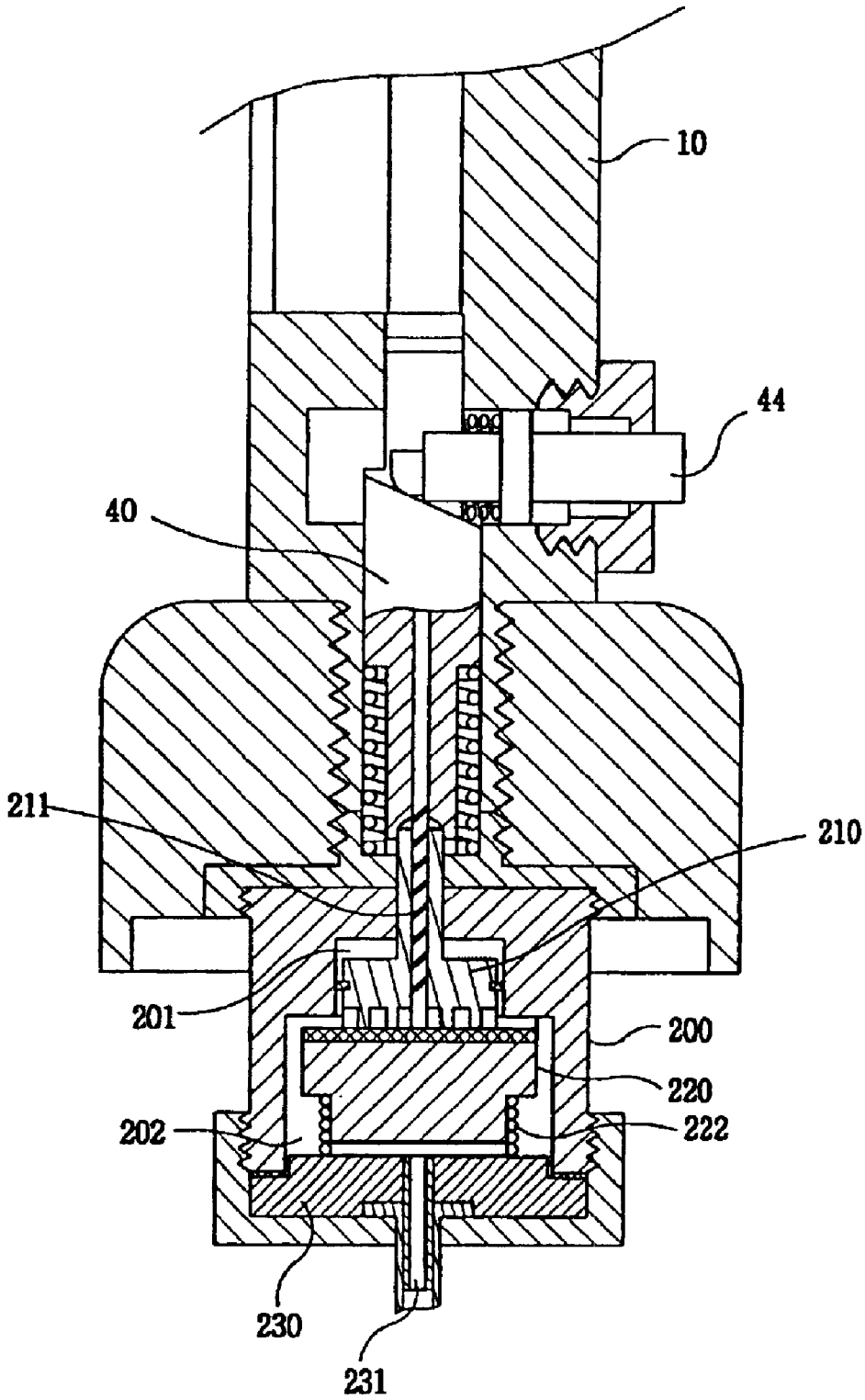
Figure 14:
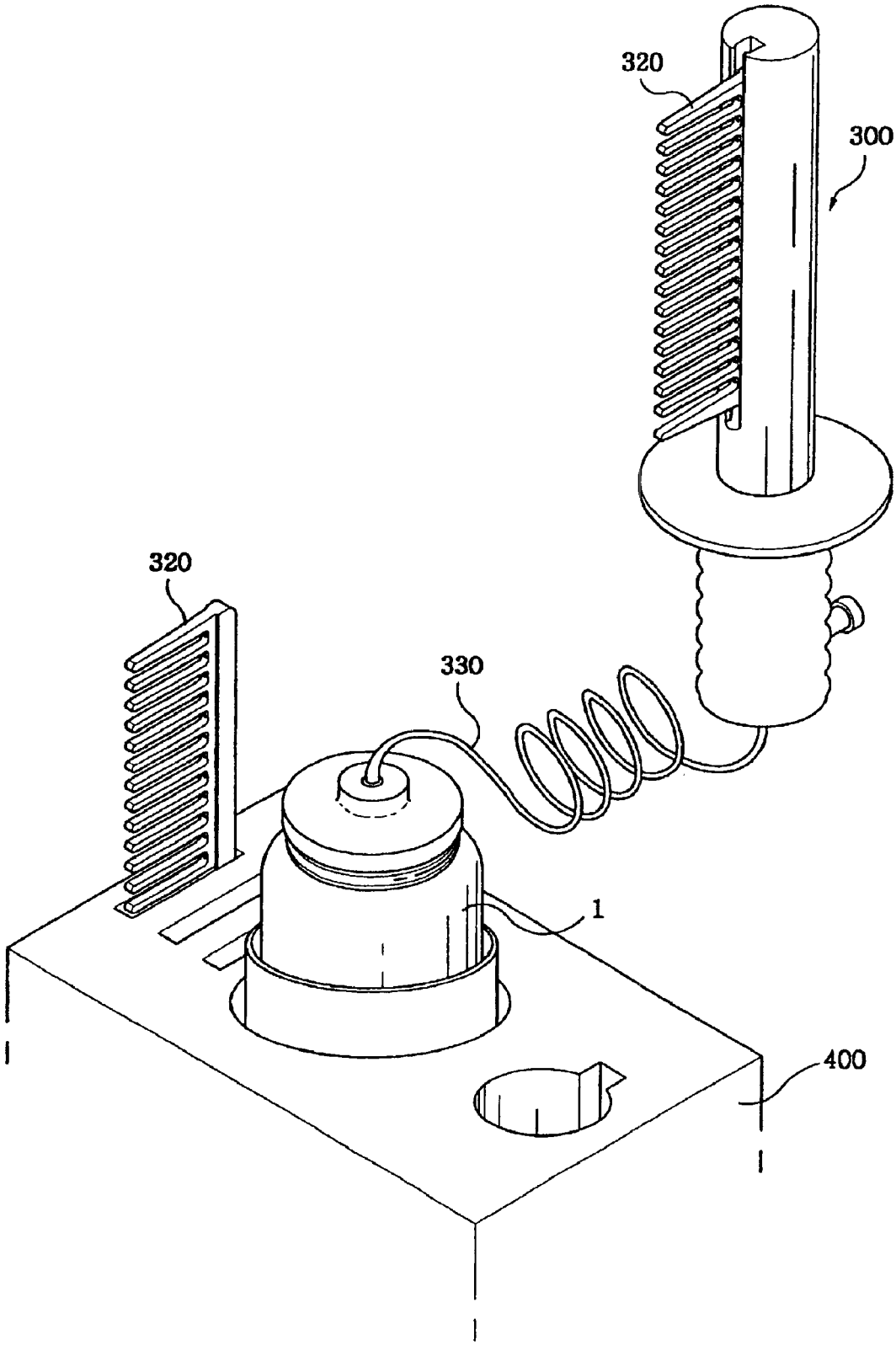
Figure 15:
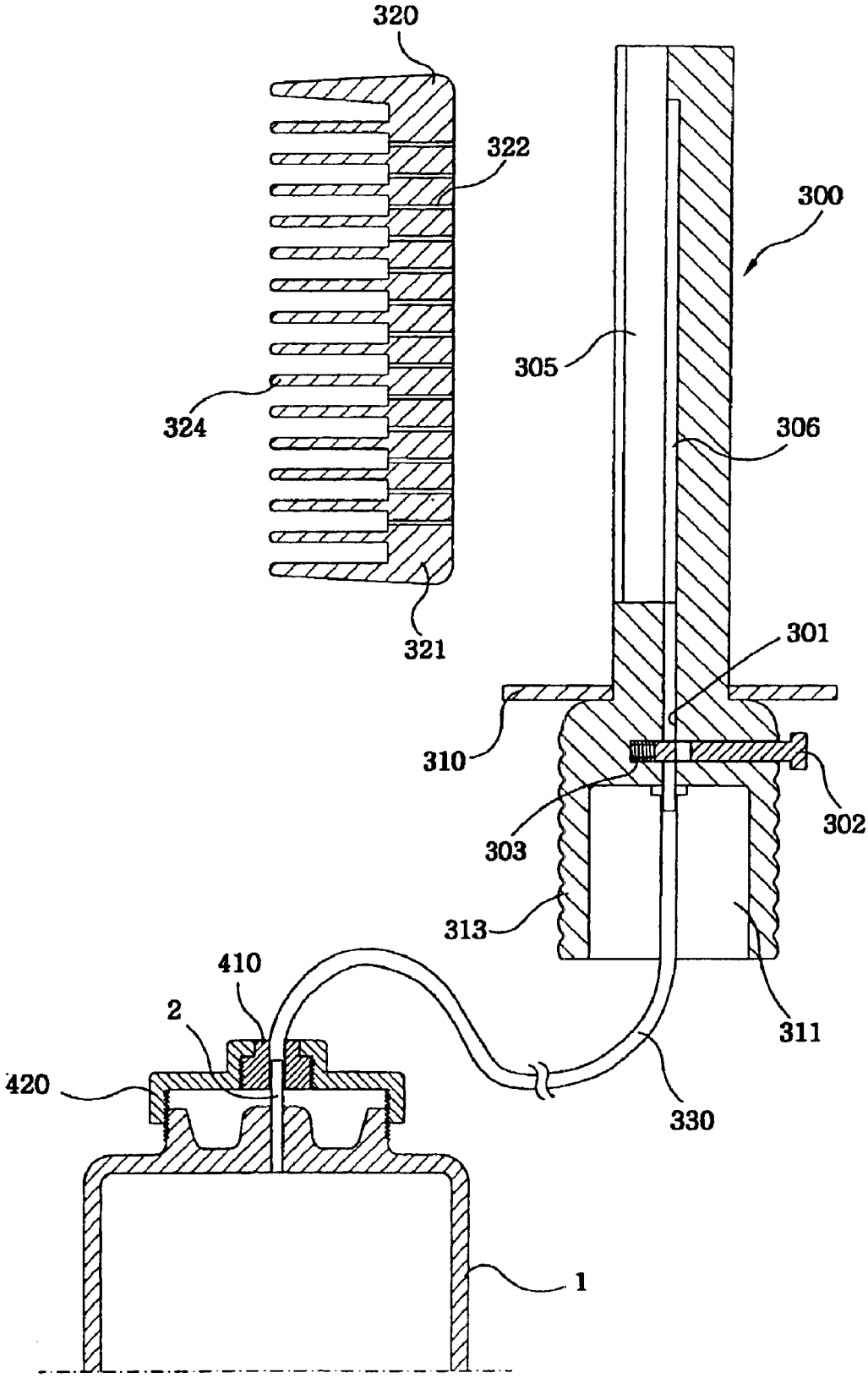
Figure 16:
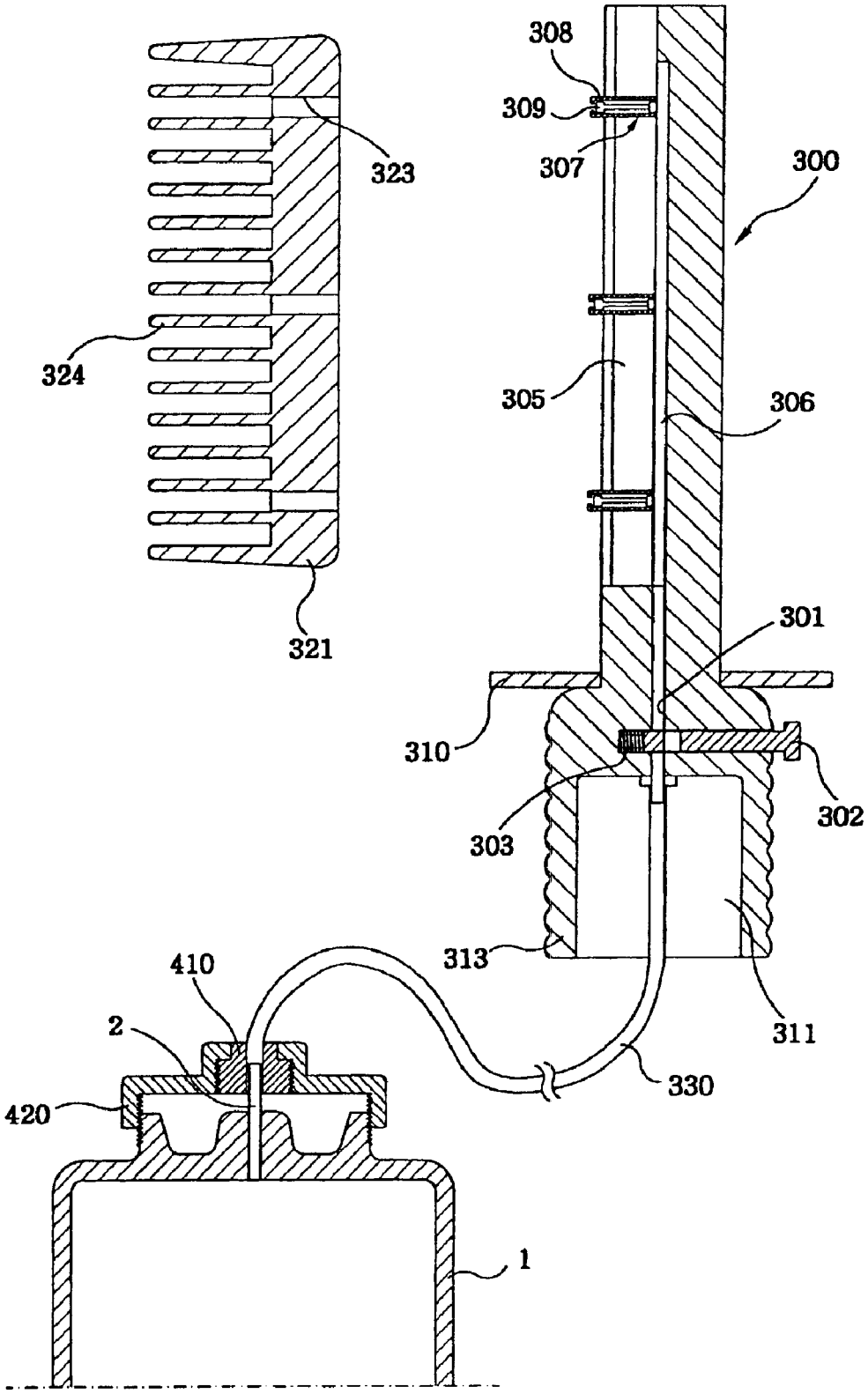
Figure 17:
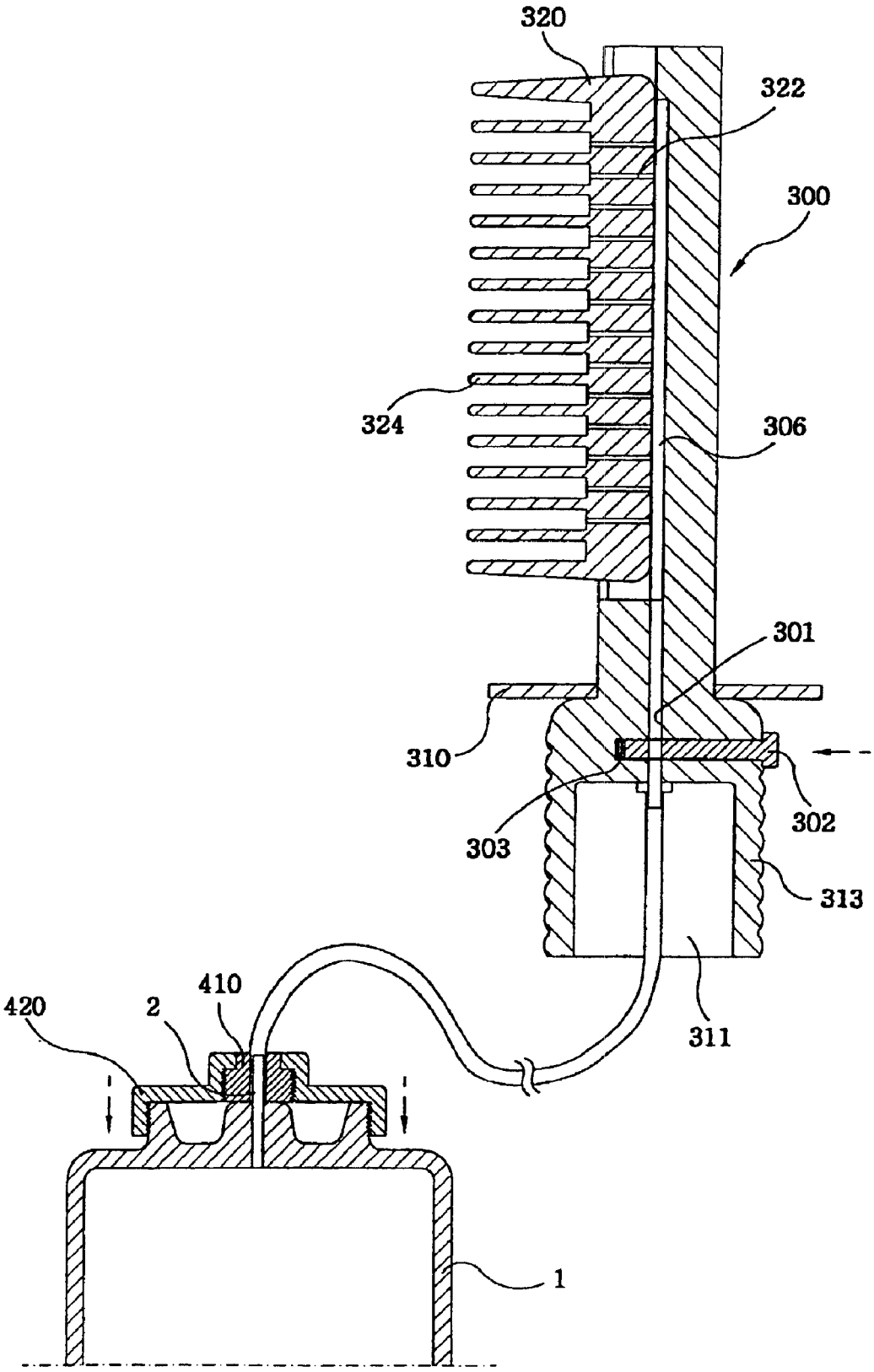
Figure 18:
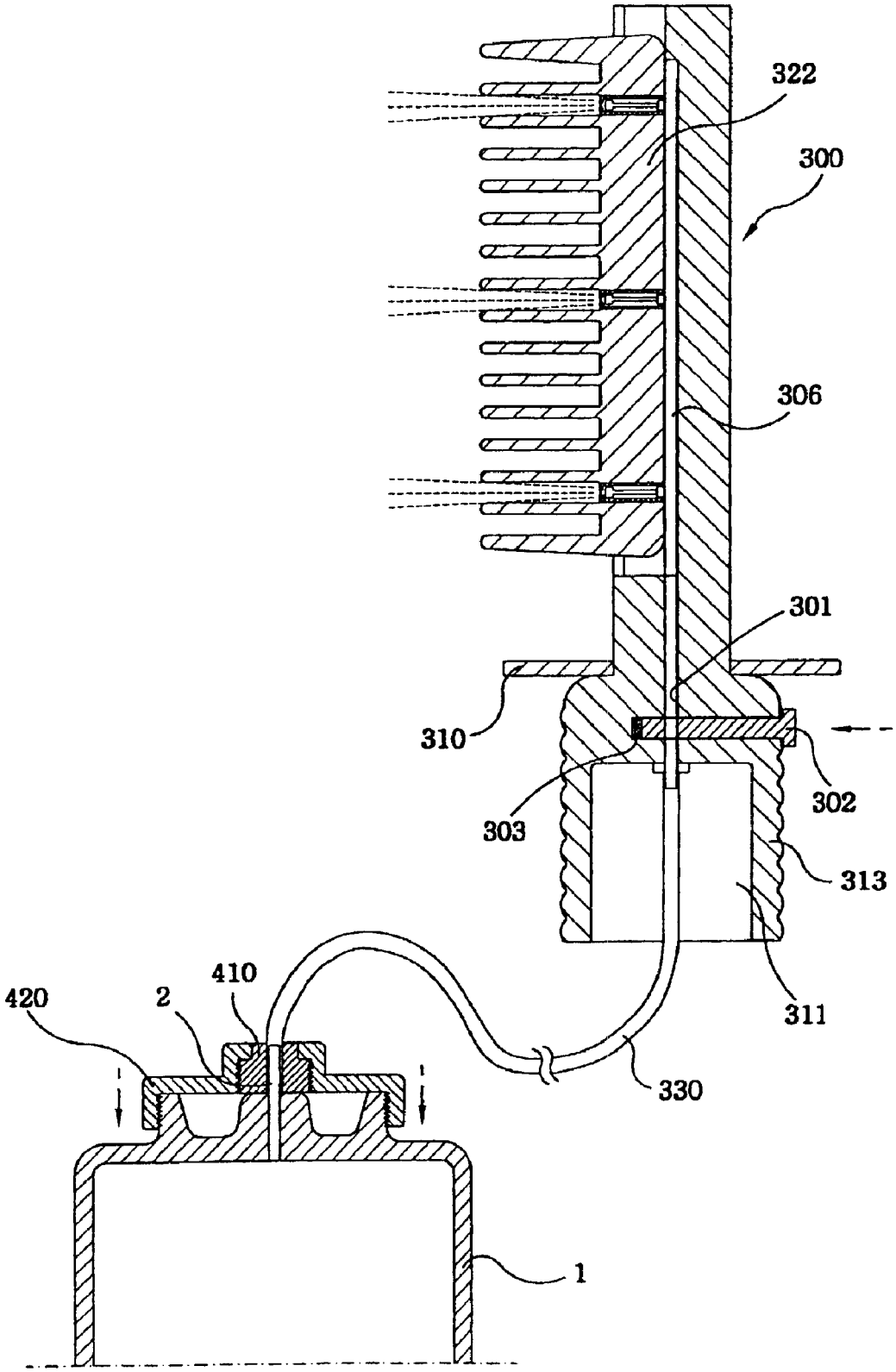
Figure 19:
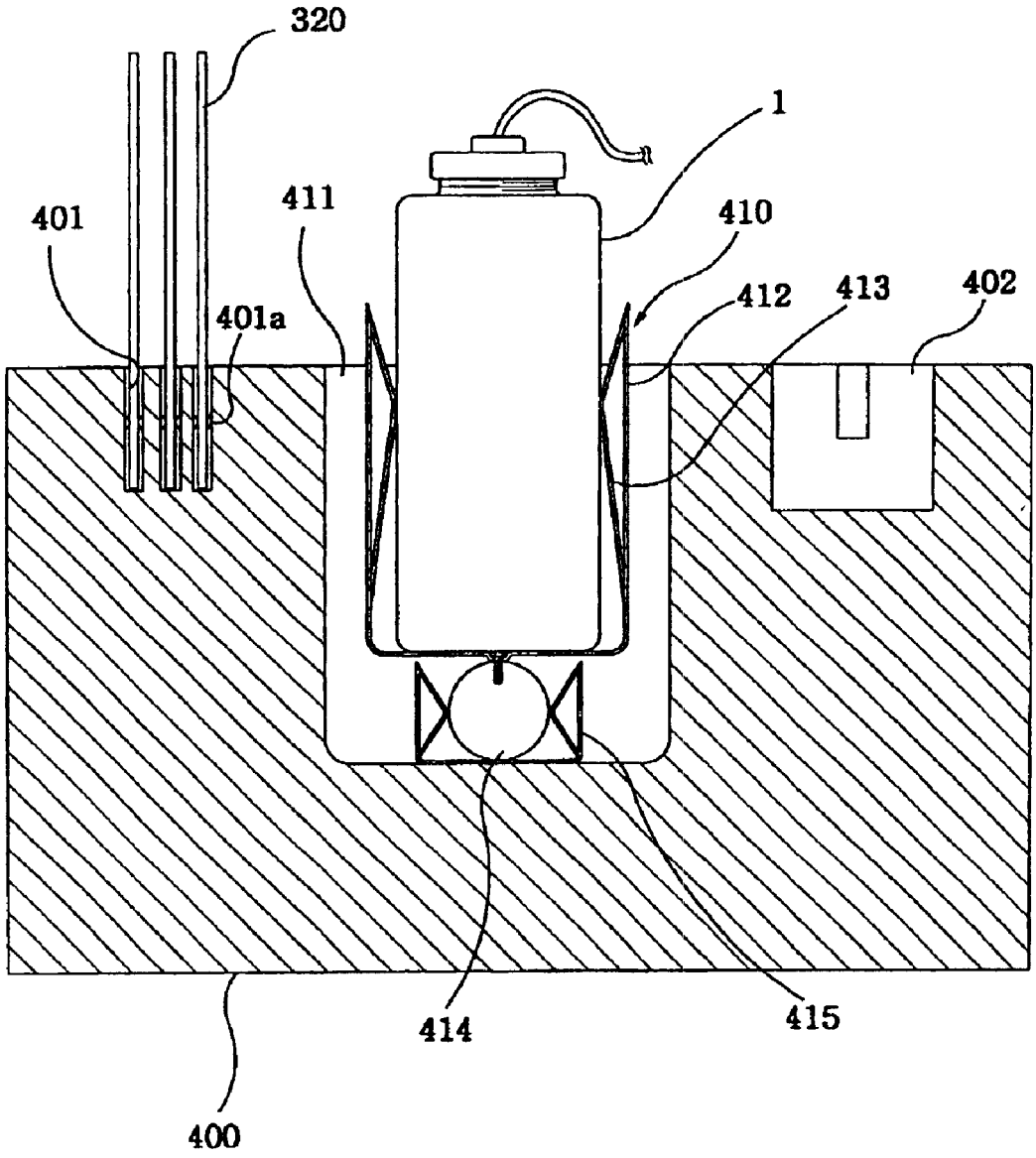
Figure 20:
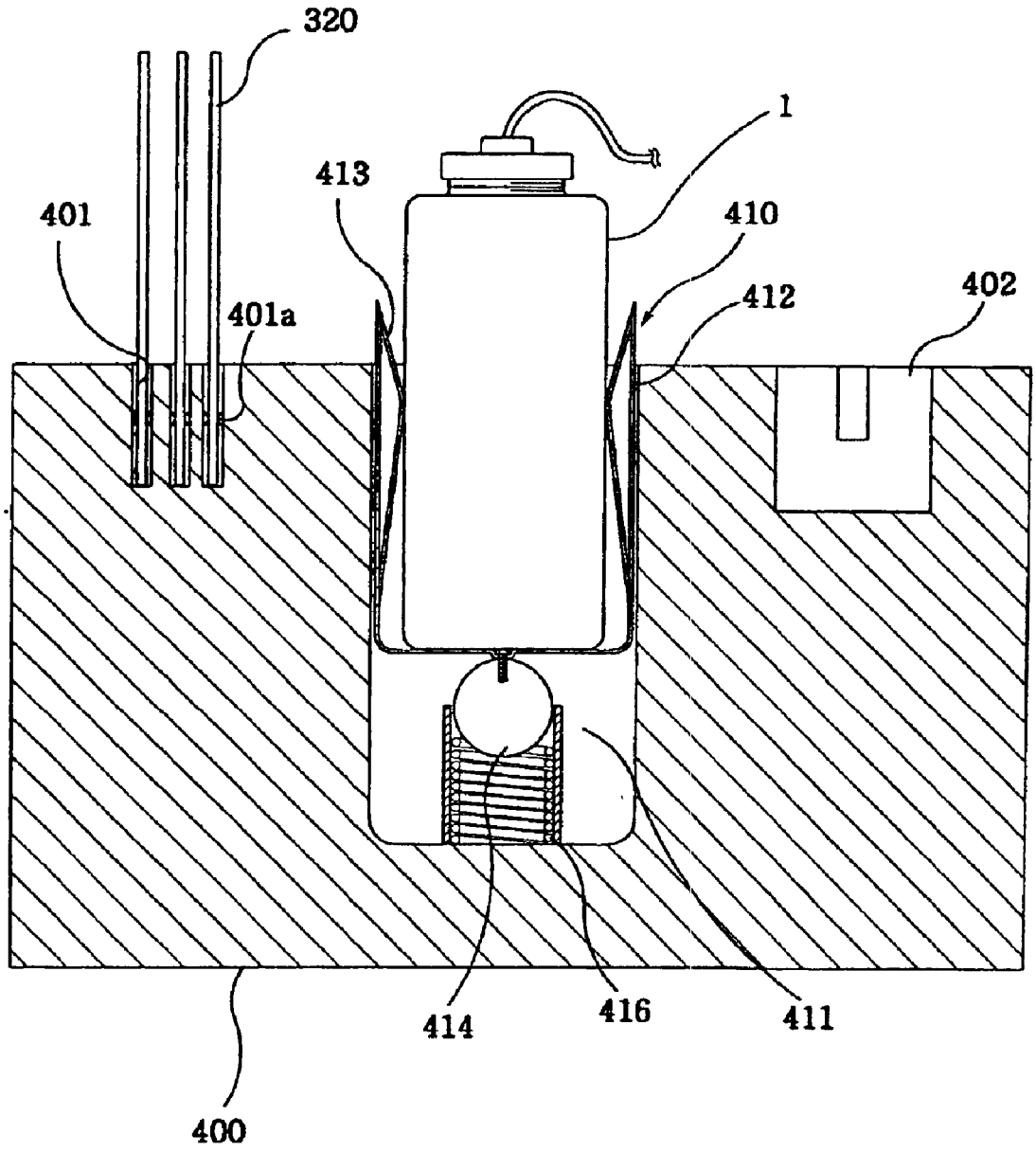
Figure 21:
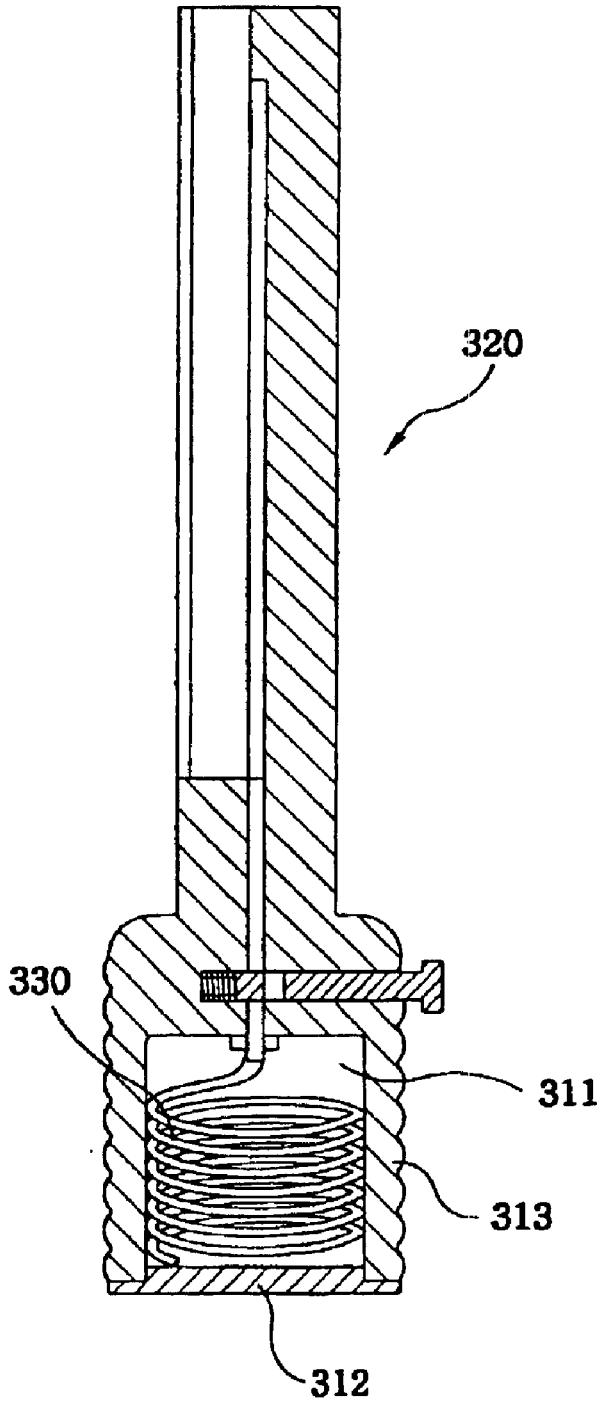
Figure 22:
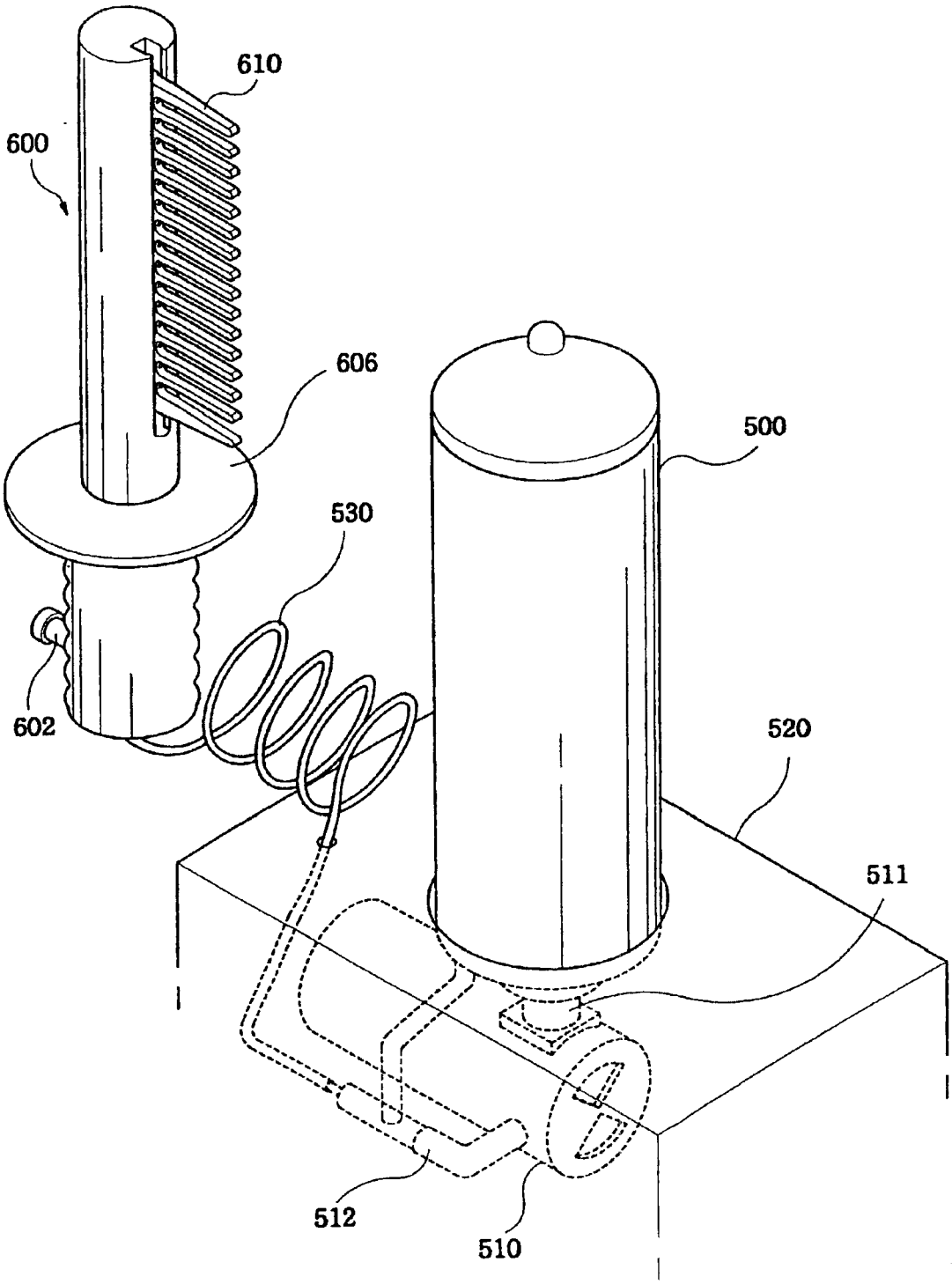
Figure 23:
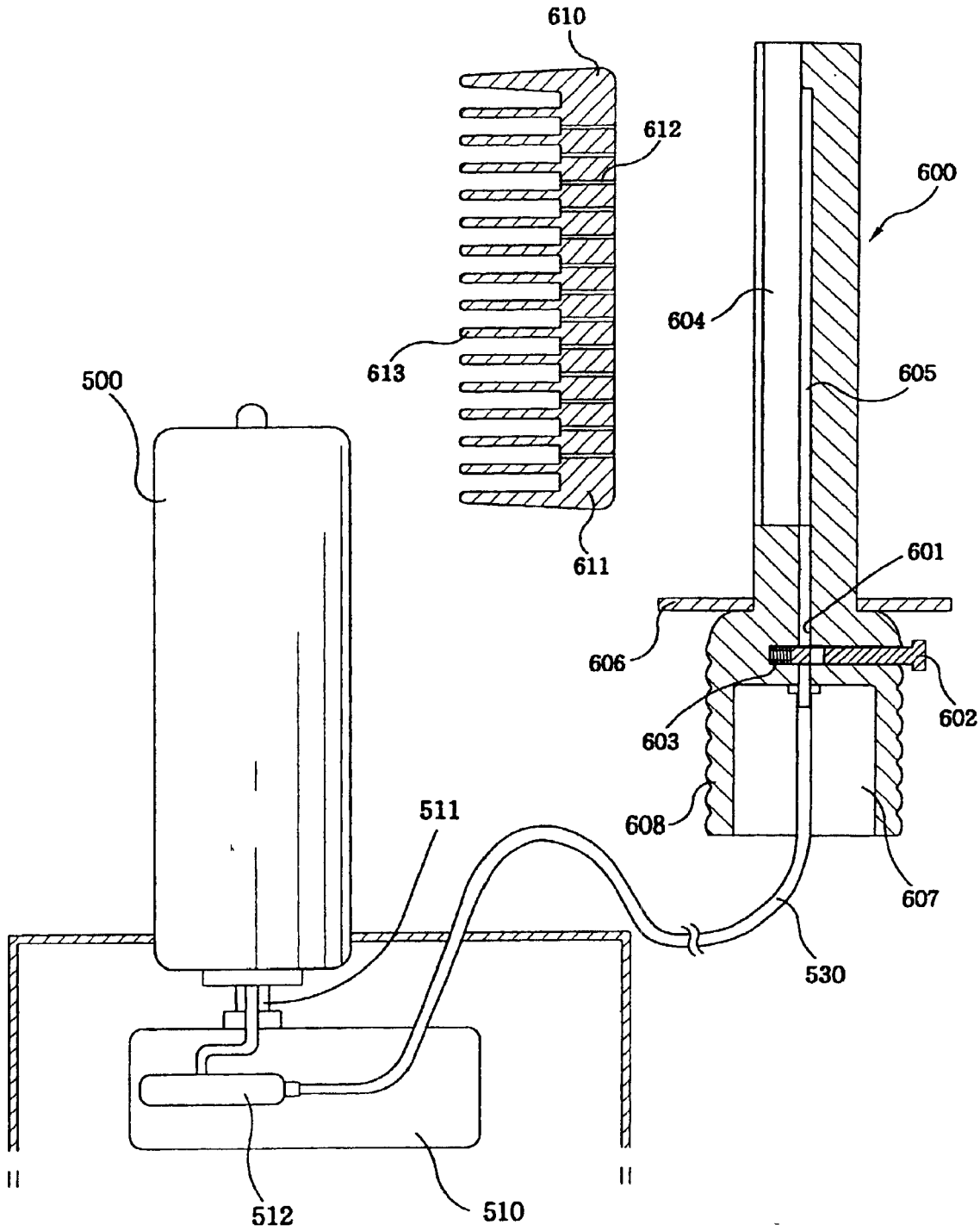
Figure 24:
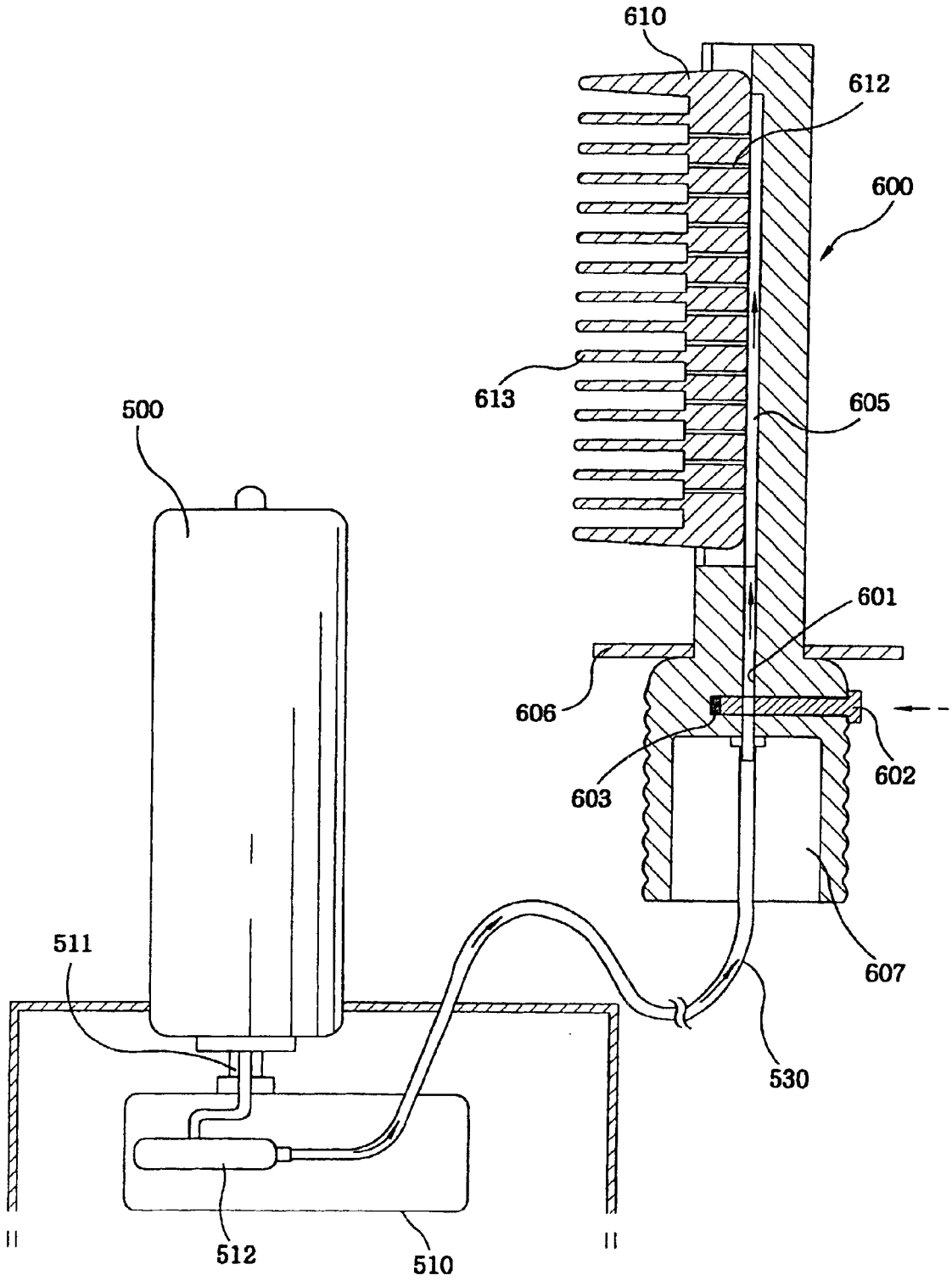
Figure 25:
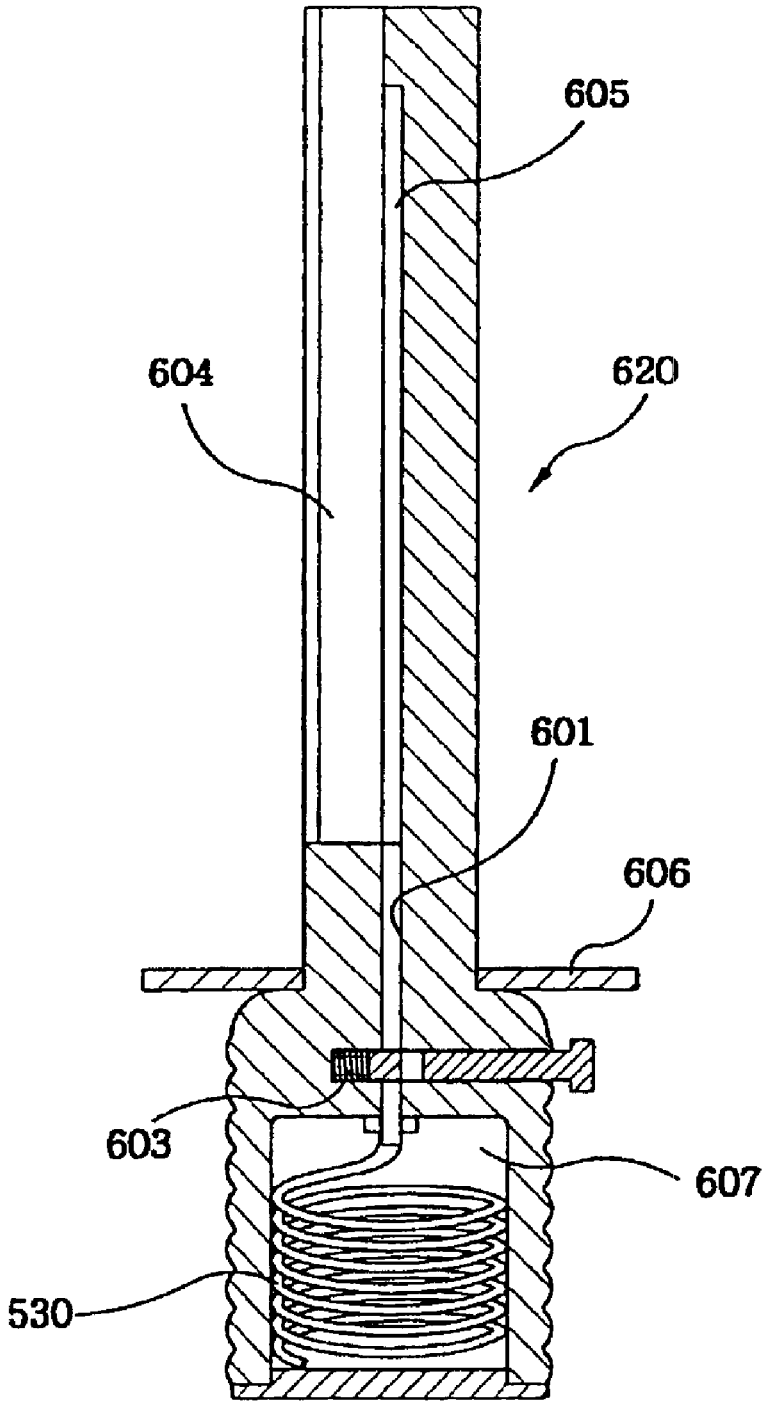
Figure 26:
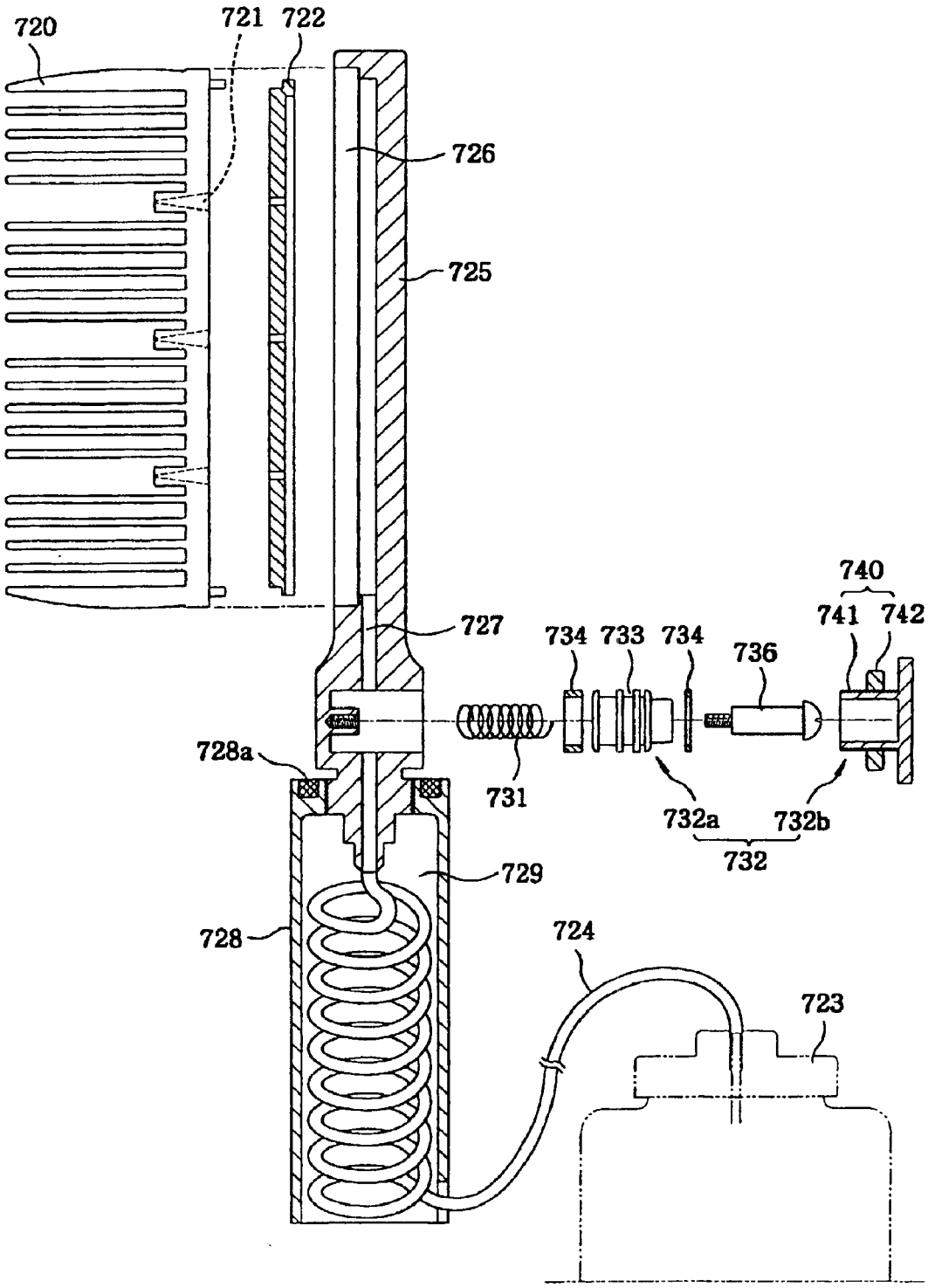
Figure 32:
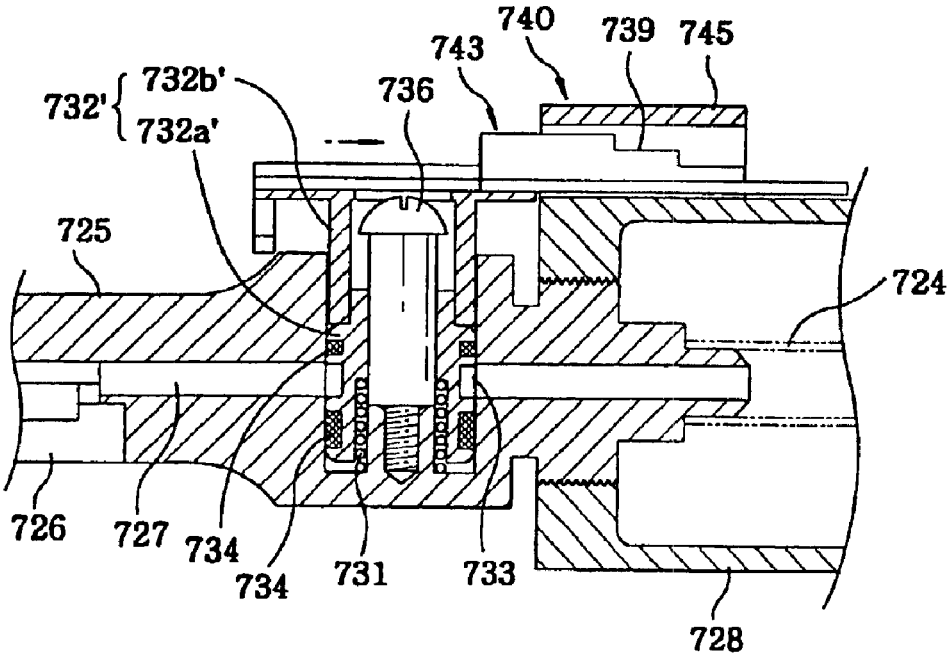
Figure 33:
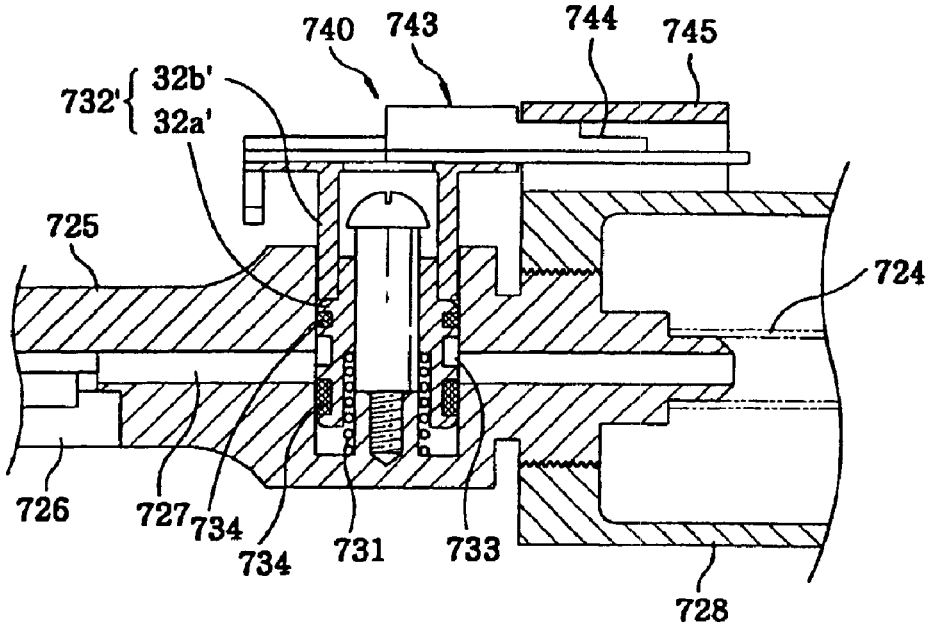
Figure 34:
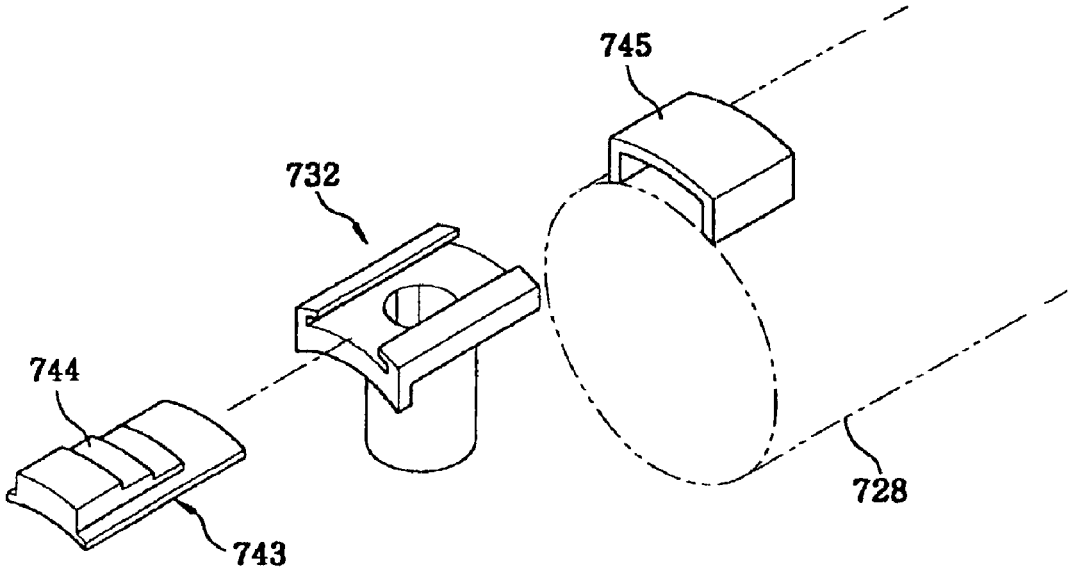

The above and other objects and features of the present invention will become apparent from the following description of preferred embodiments given in conjunction with the accompanying drawings, in which:

FIG. 1 shows a perspective view of a hair setting device in accordance with the first preferred embodiment of the present invention, FIG. 2 illustrates an exploded perspective view of the hair setting device in accordance with the first preferred embodiment of the present invention, showing the configuration thereof;

FIG. 3 describes a cross-sectional view of the hair setting device in accordance with the first preferred embodiment of the present invention, showing the structure thereof, FIGS. 4A and 4B represent cross-sectional views of the hair setting device in accordance with the first preferred embodiment of the present invention, showing the operating mechanism of a valve, FIG. 5 is a perspective view of a hair setting device in accordance with the second preferred embodiment of the present invention, FIG. 6 offers a cross-sectional view of the hair setting device of FIG. 5, showing the manner of adjusting the length of teeth of a comb, FIG. 7 provides a perspective view of a hair setting device in accordance with the modified second embodiment, FIG. 8 sets forth a cross-sectional view of the hair setting device of FIG. 7, showing the manner of adjusting the length of teeth of a comb, FIG. 9 portrays a cross-sectional view of a comb for a hair setting device in accordance with the third embodiment of the present invention, FIGS. 10 and 11 are cross-sectional views of combs for a hair setting device in accordance with the modified third embodiments, respectively, FIG. 12 is a schematic view of a hair setting device comprising a mousse supply in accordance with the fourth embodiment of the present invention, FIG. 13 is a cross-sectional view showing the operation of the hair setting device of the fourth embodiment, FIG. 14 is a perspective view of a hair setting device comprising a mousse/hair-spray supply in accordance with the fifth embodiment of the present invention, FIGS. 15 and 16 are cross-sectional views of the hair setting device of the fifth embodiment, showing the configuration of the mousse/hair-spray supply, respectively, FIG. 17 is a cross-sectional view of the hair setting device of the fifth embodiment, showing the mousse/hair-spray supply in operational position for mousse, FIG. 18 is a cross-sectional view of the hair setting device of the fifth embodiment, showing the mousse/hair-spray supply in operational position for hair spray, FIGS. 19 and 20 are cross-sectional views of the mousse/hair-spray supplies having different configurations, respectively, FIG. 21 is a cross-sectional view of a grip member, showing a tube accommodated in the grip member, FIG. 22 is a perspective view of a hair setting device in accordance with the sixth embodiment of the present invention, FIG. 23 is a cross-sectional view of the hair setting device in accordance with the sixth embodiment, FIG. 24 is a cross-sectional view of the hair setting device in accordance with the sixth embodiment, showing the device in operation, FIG. 25 is a cross-sectional view of a grip member, showing a tube accommodated in the grip member, FIG. 26 is a cross-sectional view of a hair setting device in accordance with the seventh embodiment of the present invention, FIGS. 27 to 30 are cross-sectional partial views of the hair setting device shown in FIG. 26, FIGS. 31 to 33 are cross-sectional partial views of the hair setting device in accordance with the modified seventh embodiment, and FIG. 34 is an exploded perspective view of a portion of the hair setting device.

DESCRIPTION OF SPECIFIC EMBODIMENTS

A first preferred embodiment of the present invention will be explained with reference to FIGS. 1 and 2.

FIG. 1 is a perspective view of a hair setting device in accordance with the first preferred embodiment of the present invention. FIG. 2 illustrates an exploded perspective view of the hair setting device and shows configurations of respective parts of the hair setting device. FIG. 3 describes a cross-sectional view of the hair setting device, showing an-inside structure of the hair setting device. FIGS. 4A and 4B represent cross-sectional views of the hair setting device, showing an operating mechanism of a valve.

As shown in FIG. 1, the hair setting device comprises a comb 30, a body 10 for guiding a setting material, e.g., mousse, from a setting material container 1 to the comb 30 and a container fixing portion 20 for fixing the body 10 to the container 1.

The body 10 is of hollow pipe shape and has a void space inside thereof. As shown in FIGS. 2 and 3, a guide groove 11 for accommodating the comb 30 is formed at a side of the body 10 along a lengthwise direction thereof. The guide groove 11 extends to an end of the body 10 through where a base portion 31 of the comb 30 is inserted into the guide groove 11 or disengaged therefrom. The guide groove 11 includes stepped portions 12 at both inner side surfaces thereof, thereby preventing the comb 30 from being separated therefrom unintentionally. Further, a slit 13 is formed at a bottom of the guide groove 11, which makes the guide groove 11 to communicate with the void space of the body 10.

At a bottom portion of the body 10, there is provided the container fixing portion 20 which has a cylindrical shape and is used for fixing the body 10 to the container 1. The container fixing portion 20 has a stepped portion 22 on an inner periphery thereof which is engaged with a ring-shaped protrusion 3 of the container and a through-hole 21 which is formed on a top surface and has screw thread on an inner surface thereof. A screwed portion 14 formed at the bottom portion of the body 10 engages with the screw thread of the through-hole 21, thereby the void space of the body 10 and an inner area of the container fixing portion 20 communicating with each other. When the container fixing portion 20 is engaged with the container 1, the nozzle of the container 1 is disposed below the through-hole 21 of the container fixing portion 20.

In the above embodiment, the container fixing portion 20 is provided as a separated element. However, the container fixing portion 20 can be provided integrated with the body 10.

An operating valve 40 is provided inside of the screwed portion 14. The operating valve 40 is in contact with a nozzle 2 of the container 1 and elastically supported by a spring 43. At the center portion of the operating valve 40, there is provided a mousse outlet 41 for delivering the mousse discharged out of the container 1 to the void space of the body 10. At the lower portion of the body 10, there is provided a push button 44 which is installed in a radial direction and supported by the spring 43. The push button 44 has an inclined surface 42 in contact with another inclined surface 45 of the operating valve 40 so that, when the push button is pressed, the inclined surfaces interact with each other and the operating valve 40 is moved downward.

The reference numeral 46 is a bush and 47 is an O-ring for maintaining air-tightness.

As mentioned above, the hair setting device comprises the comb 30 which includes the base portion 31 detachably engaged with the guide groove 11 of the body 10 and a plurality of discharging holes 32 formed on the base portion in a regular interval for discharging the mousse. The comb may have various teeth interval or teeth length for various uses.

The operation of the hair setting device of the first embodiment will now be described hereinafter.

First, the body 10 and the container fixing portion 20 are assembled together. Then, the container fixing portion 20 is installed in the container 1 by engaging the stepped portion 22 of the container fixing portion 20 with the ring-shaped protrusion 3 of the container 1. After the container fixing portion 20 is installed in the container 1, the nozzle 2 is aligned with the mousse outlet 21 of the operating valve 40.

Thereafter, user selects a comb suitable for the user's purpose and then engaging the comb 30 with the body 10 by inserting it into the guide groove 11. On the other hand, the comb 30 may be inserted into the body 10 before the body 10 is assembled with the container 1. The body 10 need not be exchanged while mousse is remained in the container 1 while the comb is exchanged from time to time when needed.

FIGS. 4A and 4B represent cross-sectional views of the hair setting device in accordance with the first preferred embodiment of the present invention, showing the operating mechanism of a valve. When the push button 44 is pressed after the container 1 and the hair setting device, the operating valve 40 moves downward by the interaction of the inclined surfaces 42, 45 and then presses the nozzle, thereby mousse being discharged from the container 1. The discharged mousse flows into the mousse outlet 41 and then to the void space of the body 10. When the pressure in the void space reaches to a sufficient level, mousse flows into the slit 13 and then discharged through the discharging holes 32 in the base portion 21 of the comb 30, thereby allowing the comb to supply mousse to hair while combing.

Each discharging outlet 32 is disposed in the base portion 31 of the comb 30 and between teeth thereof, thereby a sufficient amount of mousse can be supplied to the comb 30. Further, each tooth of the comb 30 has guides 34 for guiding the discharged mousse to the end portion of the tooth 33.

According to the present invention, mousse can be supplied from the container to the comb by pressing the push button. Therefore, one can make one's style without having one's hand stained with mousse and there is no need to stop combing in order to fill up mousse on the comb. Further, various hair styles can be produced with various combs.

A second preferred embodiment of the present invention will be explained with reference to FIGS. 5 and 8. FIG. 5 shows a manner how a control bar engages with the comb. FIG. 7 shows a hair setting device in accordance with a modified second embodiment. FIGS. 6 and 8 show the manners how the lengths of teeth of the comb are adjusted, respectively.

As shown in FIGS. 5 and 7, the hair setting device comprises a comb 30 including a control bar 50, a body engaged with the comb 30 and delivering mousse from a container 1 to the comb 30, and a container fixing portion 20 for fixing the body 10 to the container 1.

As shown in FIG. 5, the control bar has a rectangular shape and engages with the comb 30. The control bar 50 may be made of organic resin and the thickness or the width thereof is determined such that one can move the control bar by one's hand.

For fixing the control bar 50 at a desired position on the comb 30 in order to adjust the length of the teeth, positioning protrusions 34 are provided in a regular interval at both side portion of the comb 30 and engaging protrusions 51 corresponding to the positioning protrusions 34 are provided on the inner surface of the control bar 50.

Therefore, as shown in FIG. 6, the control bar 50 can be moved on the comb 30 toward the base portion 31 or end portion of the teeth and then fixed at a desired position by the interaction of the positioning protrusions 34 and the engaging protrusions 51, thereby adjusting the length of the teeth.

In the modified second embodiment shown in FIGS. 7 and 8, the comb 30 has a control bar inserting slit 35 in the teeth 33 thereof and a control bar 60 is inserted into the slit 35.

The control bar inserting slit 35 extends from the end portion of the teeth 33 toward the base portion 31 and the control bar 60 is inserted into the slit 35. The slit 35 has positioning protrusions 61 on the inner side surfaced thereof and the control bar 60 has engaging protrusions 61 on the surface thereof. Therefore, the position of the control bar 60 can be determined in the same manner described above.

According to the present invention, the length of the teeth 33 of the comb 30 can be adjusted by changing the position of the control bars 50 and 60 engaged with the comb 30 and thus one can use the hair setting device for various uses without changing the comb 30.

Further, mousse can be supplied from the container to the comb by pressing the push button. Therefore, one can make one's style without having one's hand stained with mousse and there is no need to stop combing in order to fill up mousse on the comb. Moreover, various hair styles can be made by changing the position of the control bar without changing the comb.

A third embodiment of the present invention will now be described with reference to FIGS. 9 to 11.

As shown in FIG. 9, a comb 100 includes a base portion 110 and teeth 120. The comb 100 is connected to a main body 10 of a hair setting device by fitting the base portion 110 of the comb 100 into a guide groove 11 formed on the main body 10 (See FIG. 2).

Further, a storage part 111 is formed at the base portion 110 of the comb 100 and stores setting materials provided to the guide groove 11 through the main body 10 of the hair setting device. The storage part 111 includes spouting holes 112 formed therein for spouting out the setting materials supplied from a container 1 toward the space between the teeth 120. The storage part 111 stores therein a certain amount of setting materials when the setting materials are provided from the container 1 and then discharging the setting materials through the spouting holes 112 in order to control the discharging pressure or discharge rate of the spouted materials to be same.

The spouting holes 112 starting from the inside of the storage part 111 are formed in such a manner that outlets thereof are disposed between the teeth 111 or at a side of each of the teeth 120 after passing through central portions of the teeth 120. Absorbent members 130 are installed adjacent to the spouting holes 112 between the teeth 120 in order to absorb the setting materials discharged from the spouting holes 112.

The absorbent members 130 prevent the discharged setting materials, e.g., mousse, from being liquefied and flowing down along the surface of the teeth 120 or the main body 10 when the mousse touches the teeth 120. Further, the absorbent members 130 uniformly touch the surface of a user's hair and help the mousse contained therein to be evenly distributed.

In general, the absorbent members 130 are made of sponge or sponge-like materials and can have a form of a brush or the like if required.

FIG. 10 and FIG. 11 show different types of absorbent members. In FIG. 10, the spouting holes 112 and brushes 131 are located between the teeth 120, wherein the brushes 131 function as the absorbent members 130 and are installed in parallel with each of the teeth 120. On the other hand, in FIG. 11, the spouting holes 112 are positioned such that the outlets thereof are located at sides of each of the teeth 120 and the brushes 131 are installed in a discharging direction of the spouting holes 112.

Accordingly, the setting materials provided to the main body 10 from the container 1 are spurted to the guide groove 11 through the inside of the main body 10 and gathered in the storage part 111 formed on the base portion 110 of the comb 100. Then the gathered setting materials are spurted out between the teeth 120 at an identical discharge rate or blast pressure through the spouting holes 112. Thus spurted-out setting materials are firstly absorbed by the absorbent members 130 and then uniformly coated on user's hair when the user combs.

Further, the combs shown in FIGS. 10 and 11 can be used in dying hair as well as putting hair setting materials, e.g., mousse.

As described above, the combs in accordance with the third embodiment of the present invention employs the absorbent members to prevent the hair setting materials discharged from the spouting holes in the hand part from being liquefied in contact with the teeth and flowing down the teeth. The absorbent members also help the hair setting materials to be uniformly coated on the user's hair by uniformly touching the hair when combing.

A fourth embodiment of the present invention will be described hereinafter with reference to FIGS. 12 and 13.

As shown in FIG. 12, a mousse supplying device includes a valve housing 200 having therein a nozzle settling part 201 and a mousse introducing room 202, a blast nozzle located at the nozzle settling part 201 of the valve housing 200 with one end thereof projected out of the top of the valve housing 200 and connected to an operating valve 40 of a main body 10, an adjustable valve 220 located within the mousse introducing room 202 of the valve housing 200 and moved upward and downward by the blast nozzle 201 for gating the nozzle settling part 201 and the mousse introducing room 202, a barrierplate 230 installed at a bottom of the valve housing 200 for blocking the mousse introducing room 202, a mousse introducing hole 231 formed on the barrierplate 230, a spring 222 located between the barrierplate 230 and the adjustable valve 220 for supporting the variable value 220, a hose 250 whose one end is connected to the mousse introducing hole 231 of the barrierplate 230, a motor pump 260 connected to the valve housing 200 through the hose 250 and a mousse absorbing pipe 161.

The valve housing 200 has a shape of a cylinder and a screw thread formed therearound. The valve housing 200 is connected to the main body 10 either by directly engaging the screw thread thereon with the main body 10 or by using a bush. The nozzle settling part 201 is prepared at an upper portion of the valve housing 200 and the mousse introducing room 202 is formed at the bottom portion of the valve housing 200. The nozzle settling part 201 and the mousse introducing room 202 are controlled to communicate with each other or be blocked from each other by movements of the adjustable valve 220 installed within the mousse introducing room 202. The adjustable valve 220 moves along with the blast nozzle 210 located at the nozzle settling part 201 and the blast nozzle 210 is interlocked with the operating valve 40 of the main body 10. The end portion of the blast nozzle 210 whose lower part is fixed on the nozzle settling part 201 within the valve housing 200 is projected out of the top of the valve housing 200. Accordingly, if the valve housing 200 is connected to the main body 10, the end portion of the blast nozzle 210 becomes to abut on the operating valve 40 of the main body 10. Thus, when the operating valve 40 is pressed and pushed down by a bottom 44, the blast nozzle also moves downward along with the operating valve 40 and operates to press the adjustable valve 220.

Further, an O-ring is installed at an outer surface of the blast nozzle 210 so as to firmly adhere the blast nozzle to the inner surface of the nozzle settling part 201. A rubber plate 221 is attached to the top of the adjustable valve 220 in order to seal areas between the nozzle settling part 201 and the mousse introducing space 202.

The mousse introducing space 202 is sealed by the barrier plate 230 installed at the bottom of the valve housing 200 and the mouse inlet 231 is formed at a center of the barrier plate 230. The motor pump 260 is coupled to the mousse introducing hole 231 through the hose 250. A hose fixing cover 240 is connected to the valve housing 200 so as to fix the hose 250 at the barrier plate 221. Further, the spring 222 is installed between the barrier plate 230 and the adjustable valve 220 to support the adjustable valve upward and helps the adjustable valve 220 in separating the nozzle settling part 201 and the mousse introducing space 202.

The motor pump 260 is connected to the inside of a mousse container 270 through the mousse absorbing pipe 261. The operation of the motor pump 260 is controlled by a pressure sensor (not shown) and automatically initiated when an internal pressure of the valve housing 200 falls below a predetermined level.

Meanwhile, the blast nozzle 210 and the mousse absorbing pipe 261 in accordance with the fourth embodiment of the present invention have a plurality of mousse inlets 212 and 262, respectively. Thus, though end portions of the blast nozzle 210 and the mousse absorbing pipe 261 are adhered to the top of the adjustable valve 220 and the inner bottom of a container 1, respectively, introduction of the mousse can be performed through the side thereof. Further, a swirling line 211 is formed at the inner surface of the blast nozzle 210 to allow the mousse passing through the nozzle 210 to flow in whirls and form bubbles.

Next, the way of using the mousse supplying device in accordance with the fourth embodiment and effects thereof will be described hereinafter with reference to FIG. 13. First, the mousse container 270 containing therein a great amount of mousse is placed at a separated place and the motor pump 260 is installed adjacent to the mousse container 270, wherein the mousse container 270 and the motor pump 260 are connected to each other through the mouse absorbing pipe 261. Thereafter, the valve housing 200 is connected to the body of the hair setting device and also connected to the motor pump 260 by fitting the hose 250 to the mousse introducing hole 231 on the barrier plate 230 which is formed at the bottom of the value housing 200.

One end portion of the operating valve 40 is an incline and the incline is in contact with the button 44. Thus, when a user presses the button 44, the operating valve 40 is also pressed and transferred downward to thereby press the blast nozzle 210 and the adjustable valve 220 as well. When the adjustable valve 220 is pressed, the mousse introducing space 202 and the nozzle settling part 201 once blocked from each other come to be inter-communicated and the mousse provided to the mousse introducing space 202 is spouted through the blast nozzle 210 and introduced to the inside of the body 10 through the operating valve adjacent to the blast nozzle 210. When passing through the blast nozzle 210, the mousse is forced to swirl and generate bubbles by the spiral lines formed at the inner surface of the blast nozzle 210.

When the mousse is discharged from the blast nozzle 200, the pressure within the valve housing 200, i.e., the pressure in the mousse introducing space 202 is lowered and the lowered pressure is detected by a pressure sensor. Then, the operation of the motor pump 260 is automatically initiated so that the mousse is provided from a mousse container 170 through the mousse absorbing pipe 261.

Meanwhile, when the user stops to press the button 44, the adjustable valve 220 reverts to a previous location by an elastic force of a spring 22 to thereby isolate the nozzle settling part 201 from the mousse introducing space 202. However, when the mousse is introduced into the mousse introducing space 202 and thus the pressure therein increases, the pressure sensor automatically stops the operation of the motor pump 260.

In the fourth embodiment of the present invention as described above, the mousse container is not directly connected to a hair setting device but located at a separated place. Accordingly, the hair setting device can be miniaturized and light-weighed. Further, since a non-gas-cylinder-type mousse container with higher capacitance is placed at a separated place, an environmental pollution and a gas explosion can be prevented and manufacturing costs can be reduced.

A fifth embodiment of the present invention will now be described with reference to FIGS. 14 to 21.

In a mousse or spray supplying device in accordance with the fifth embodiment, a handle 300 having a comb 320 attached thereto is connected to a container 1 through a tube 330. Hair setting materials contained in the container 1 is provided to the handle 300 through the tube 330 and spouted between teeth of the comb 320.

The mousse/hair-spray supplying device in accordance with the present embodiment includes the handle 300 removably connected to the comb 320 and coupled to the container 1 through the tube 330, various types of combs 320 alternatively used depending on the necessity and a case for holding the combs 320.

Referring to FIGS. 15 and 16, the base portion 300 has a shape of a hollow pipe. A carrying passage 301 is installed within the handle 300 to carry the mousse or spray solution and opened/closed by a valve button 302 formed at a lower part of the handle 300. The valve button 302 is inserted to a hole vertically communicating with the carrying passage 301 at the lower part of the handle and usually operates to block the carrying passage 301 by using a spring. However, when pressed, the valve button operates to open the carrying passage 301. An O-ring is installed between the valve button 302 and the inner surface of the hole for an airtight.

A guide groove 305 is formed on an upper portion of the handle 300 in a lengthwise direction so as to connect the handle 300 to the comb 320. A slit 306 and a nozzle 307 are installed at bottom of the guide groove 305 to connect the guide groove 305 to the carrying passage 301.

A base portion 321 of the comb 320 is engaged with the guide groove 305 of the handle 300 to thereby connect the comb 320 to the handle 300. Spouting holes 322 for spouting the mousse solution or nozzle insertion holes for protruding the nozzle 307 are formed between respective tooth 324 of the comb 320. The combs 320 have different structures depending on the hair setting materials to be contained therein. For example, a comb for spray and a comb for mousse are different. FIGS. 15 to 18 illustrate different types of combs.

FIGS. 15 to 17 show combs for mousse, wherein the spouting holes 322 are located between the teeth 324.

However, in case spray is used as a hair setting material and discharged through the spouting holes 322, the spray is readily liquefied by touching the teeth 324, thereby failing to be uniformly coated on hair. As a solution to such problem, the nozzle 307 is installed at the guide groove 305 of the handle 300 in lieu of the slit and set to be communicated with the carrying passage 301. The nozzle 307 contains a cylindrical nozzle pipe 308 with a nozzle core 309 formed therein. Spray liquid sent to the carrying passage 301 travels through a space between the nozzle core 309 and the nozzle pipe 308 and is blasted through a bole formed at an upper portion of the nozzle pipe 308. The nozzle core 309 is provided at an outer surface thereof with protrusions or grooves (not shown), which cause the spray liquid passing through the nozzle to swirl.

FIGS. 16 to 18 exhibit the combs 320 for spray, wherein a nozzle insertion hole 323 is formed at the base portion of the comb 320 instead of the spouting holes. The nozzle pipe 308 is set to be projected between the teeth 324 and no tooth is prepared where the nozzle insertion hole 323 is formed.

Various types of combs having a different tooth size and length and a different intertooth distance is provided to satisfy various needs of users.

The outer surface of the handle 300 is provided with flexure 313 so that a user can hold the handle 300 more easily and comfortably. Further, a plate 310 is prepared at one side of the outer surface of the handle 310 to prevent the mousse or the spray discharged toward the comb 320 from flowing down to the user's hand.

One end portion of the tube 330 is led to a lower part of the handle 300 and the other end portion of the tube 330 is coupled to a nozzle of the container to thereby connect the handle 300 and the container 1. Further, an empty room 311 is formed at a lower part of the handle 300 to arrange and hole the tube 330, as illustrated in FIG. 21, when the mousse or spray supplying device is not in use.

Referring to FIGS. 15 to 17, one end portion of the tube 330 is connected to the nozzle 2 of the container and fixed thereto by a fixing nut 410. Then a nozzle 2 is pressed by an operating nut 420, which is engaged with a fixing nut 410. A hole is formed through the center of the fixing nut and the tube 330 is inserted through the hole The fixing nut 410 includes a plurality of fixing piece whose lower parts are separated from each other by a plurality of groves (not shown) formed at an outer surface of the fixing nut 410 in a direction of inserting the tube 410. An operating nut 420 engaged with the fixing nut 410 encloses the outer surface of the fixing nut 410 and causes the fixing piece to tighten the tube 330. Further, a lower part of the operating nut 420 is engaged with an upper part of the container 1, wherein the joint position can be varied and the operation of the nozzle 2 can be adjusted by controlling the joint position. To be specific, when turned clockwise, the operating nut 420 becomes closely adhered to the top of the container 1. Then the applied pressure is propagated to the nozzle 2 through the fixing nut 410 engaged with the operating nut 420 and the pressured nozzle blasts the setting materials. To the contrary, when the operating nut 420 is turned counterclockwise, the pressed state of the nozzle 2 is released.

The mousse/hair-spray supplying device in accordance with the fifth embodiment as described above further includes a case 400 for keeping the comb 320, the container 1 and the handle 300.

As shown in FIGS. 19 and 20, the case 400 includes a plurality of fixing grooves 401 for holding the combs 320, a container supporting unit 410 for supporting the container 1 and a handle holder 402 for holding the handle 300. The case is sealed airtight by a cover (not shown).

The comb fixing grooves 401 are fabricated to have a size bigger than the combs in order to hold combs of various sizes. Elasticized supporting means 401*a* are installed inside of the comb fixing grooves 401 in order to support the inserted combs.

The container supporting unit 410 is prepared as follows. A hole 411 having a predetermined diameter is formed at top of the case 400 and a cylindrical container supporter 412 with an open top is movably installed in the hole 411, wherein the container 1 is inserted through the open top of the supporter 412. Springs 413 are installed at inner walls of the container supporter 412 to elastically support containers 1 having a diameter of great variety. Further, a sphere-shaped joint 414 is fixed under the container supporter 412. Joint supporter 415 or a spring 416 is installed so as to movably support the joint 414.

To be specific, the joint 414 located right under the container supporter 412 is movably supported by the joint 415 or the spring 416 and there exists a space between the outer surface of the container supporter 412 and the inner surface of the hole 411.

Accordingly, the container supporter 412 can be moved from side to side or up and down along with the container 1 inserted therein.

A way of using the mousse or spray supplying device in accordance with the fifth embodiment and effects thereof will be described hereinafter with reference to FIGS. 17 and 18.

First, when mousse is used as a hair setting material, the mousse container 1 containing therein the mousse is mounted on the container supporter 412 and connected to the handle 300 through the tube 330. Then, the comb 320 for mousse is connected to the handle 300, wherein the spouting holes 322 are formed on the comb 320 as described above.

The user shakes the container supporter 412 put within the case 410 from side to side. Then, the user presses the nozzle 2 connected to the tube 330 by using the operating nut 420. Accordingly, the mousse spouted from the nozzle 2 reaches the handle 300 through the tube 330 and the handle 300 becomes to be filled with the mousse provided. Thereafter, when the user presses the valve button 302 on the handle 300, the mousse is provided toward the spouting holes 322 through the carrying passage 301 and spouted out of the spouting holes 322 formed at the base portion 321 of the comb 320.

After shaking side to side or up and down the vessel support 412 contained in the case 400 as using the mousse vessel, the nozzle 2 connected to the tube 330 is pressed by using the operating nut 420. Accordingly, the spray liquid jetted from the nozzle 2 is filled in the tube 330 and reaches the handle 300. And if the user press the valve button 302, the carrying passage 301 is opened and the content is supplied to the nozzles 307 protruded between combing teeth 324, thereby being discharged therefrom.

While the supplying device being used, even though discharged spray or mousse runs down along the comb 320 or the handle 300, the prevention plate 310 absorbs the spray or mousse running down so that the user's hand can be kept clear.

On the other hand, while the mousse and spray supplying device in accordance with the preferred embodiment of the present invention being unused, the tube 330 disconnected from the nozzle 2 is kept in a space formed at the lower part of the handle 300 by closing a lid 312. In addition, the comb 320 can be also disconnected from the handle 300 and then the comb 320 and the handle 300 are respectively inserted into the comb holder 401 and handle holder 402 in the case 400 so that they can be kept without damages.

According to the preferred embodiment of the present invention, the mousse/hair-spray supplying device can be used with a mousse vessel or a spray vessel. In addition, since the mousse vessel or the spray vessel is fixed in the case and the user can use the supplying device holding only the handle, the supplying device can get rid of inconveniences of holding the vessel.

Hereinafter, a sixth embodiment of the present invention will be described with reference to FIGS. 22 to 25.

A hair setting device comprises a motor pump 510 installed at a vessel 500, a tube 530 connecting the motor pump 510 to a handle 600 having a comb 610, and discharging content of a vessel 500 between combing teeth, wherein the motor pump 510 installed at the vessel 500 is positioned apart from the handle 600.

Accordingly, the preferred embodiment of the present invention includes the vessel 500 containing mousse or hair gel, various kinds of the combs 610, the handle 600 in which the comb 610 is removably inserted, wherein the handle 600 and the motor pump 510 are connected to each other by the tube 530.

Referring to FIG. 22, an intake 511 of the motor pump 510 within a square-shaped case 520 is connected to the lower part of the vessel 500. The motor pump 510 has a pressure sensor therein. An outlet 512 of the pump 510 is divided into two branches, one of them being connected to the tube 530 for supplying the content to the handle 600 and the other being connected to the vessel 500. And, the content can be mixed well by feeding some portion of the content back to the vessel 500 as above mentioned.

As shown in FIGS. 23 and 24, the hollow tube-shaped handle 600 has a carrying passage 601 therein, which is opened and blocked by a valve button 602 installed at the lower portion of the handle 600. The valve button 602 is inserted in a hole formed in the lower part of the handle 600 and perpendicular to the carrying passage 601. If the valve button 602 elastically supported by a spring 603 and blocking the carrying passage 601 is pressed, the carrying passage 601 is opened.

The handle 600 has a guide groove 604 formed thereon for being coupled to the comb 610, and a slit 605 is formed on a bottom surface of the guide groove 604 so that the groove 604 can communicate with the carrying passage 601.

The comb 610 is coupled to the handle 600. That is, a grip 611 of the comb 610 is inserted in the guide groove 604. The grip 611 of the comb 610 has a plurality of discharging holes formed between combing teeth 613 and for discharging the mousse or hair gel supplied from the vessel 500.

The handle 600 has an uneven outer surface 608 so that users can hold and use it comfortably. The handle 600 also has a prevention plate 606 around the outer surface 608 for preventing the liquefied mousse or spray from flowing to user's hand. In addition, the handle 600 has a tube cabinet 607 at lower part thereof for keeping the tube 530 as shown in FIG. 24 while being unused.

Hereinafter, method and effect of using the hair setting device having a motor pump will be described.

First, the motor pump 510 installed at the vessel 500 is connected to the handle 600 through the tube 530 and the comb having discharging holes 612 is coupled to the handle 600. Thereafter, if the motor pump 510 is turned on, the content contained in the vessel 500 is filled into the tube 530. If the valve button 602 is pressed, the blocked carrying passage 601 is opened and the content is supplied to the handle 600 through the carrying passage 601 so that the content can be discharged from the discharging holes formed between the combing teeth.

While the setting device being used, even though the content discharged from the discharging holes runs down, the prevention plate 606 absorbs the content running down so that the user's hand can be kept clear.

On the other hand, if the valve button 602 returns to an original position by removing the pressure on the valve button 602, the carrying passage 601 is blocked by the valve button 602 so that the carrying passage 601 can stop supplying content to the comb 610. Accordingly, when the content is filled in the tube 530 and the pressure in the tube reaches to a certain point, the operation of the motor pump 510 is stopped automatically by the pressure sensor.

According to this preferred embodiment of the present invention, the hair setting device incorporating therein a motor pump supplies a content, e.g., a mousse, hair gel, hair dye, etc contained in the vessel to the comb so that the content can be discharged through the comb by the motor pump. As a result, users can use the setting device comfortably without holding the vessel.

The preferred embodiment of the present invention includes a motor pump 510 installed at a vessel 500 containing mousse or hair gel, a handle 600 having a comb 610 and a tube 530 connecting the handle 600 to the motor pump 510. The content of the vessel 500 supplied to the handle 600 through the tube 530 is discharged between combing teeth, and thereby used.

Hereinafter, a seventh embodiment of the present invention is described with reference to FIGS. 26 to 33.

FIG. 26 is an exploded cross sectional view of a setting material supplying device in accordance with the seventh embodiment of the present invention and FIGS. 27 to 30 are assembled cross sectional views illustrating operation modes of the setting material supplying device.

The hair setting material supplying device in accordance with the seventh embodiment includes a comb 720, a backbone 725 allowing the setting material discharged from the can 723 to be supplied to the comb 720.

The backbone 725 is provided with an assembling groove 726 in an outer surface thereof, in which the comb 720 can be removably inserted. In addition, a setting material carrying channel 727 communicating with a lower part thereof is formed in the assembling groove 726.

The comb 720 is provided with spouting holes 721 communicating with a lower part thereof through the carrying channel 727 and a nozzle. And a lower part of the backbone 725 is engaged with a handle 728 having a tube cabinet 729 formed therein. The handle 728 has an absorbent substance 728*a*, e.g., a sponge removably attached to an upper portion thereof. The setting material can 723 communicates with the carrying channel 727 through a tube 724.

The backbone 725 is provided with a setting material supplying button 732 elastically supported outward by a spring 731 and having a circular passage 733 for opening and closing the carrying channel 727 formed in outer surface thereof, and a feeding amount controller 740 for controlling a feeding amount of the setting material supplied through the carrying channel 727.

The feeding amount controller 740 includes a male screw 741 on the supplying button 732 and a polygonal control nut 742 engaged with the male screw 741 for varying the operation gap of the supplying button 732.

The supplying button 732 includes a first element 732*a* having the circular passage 733 and a second element 732*b* having the male screw 741 formed thereon. The first element 732*a* forcedly engaged with the second element 732*b* is supported by a bolt 736 threadably affixed to the backbone 725.

Referring to FIGS. 31 to 34, there is shown a modified seventh embodiment respectively including a supplying button 732' elastically supported outward by a spring 731 and having a circular passage 733' formed therein for opening and closing the carrying channel 727.

The setting material feeding amount controller 740 includes a pressuring member 743 slidably installed on a pressuring surface of the supplying button 732' and having a stepped surface thereon, and a supporting member 745 protrudingly formed on an outer surface of the backbone 725 for pressing the supplying button 732.

The supplying button 732' includes a first element 732*a'* having the circular passage 733' and a second element 732*b'* forcedly engaged with the first element 732*a'*. The first element 732*a'* is supported by a bolt 736 threadably affixed to the backbone 725.

The setting material supplying buttons 732, 732' have O-rings installed both sides of each circular passage 733, 733' for sealing.

The hair setting material supplying device in accordance with the preferred embodiment of the present invention supplies the setting material to the comb as follows.

Figure 27:
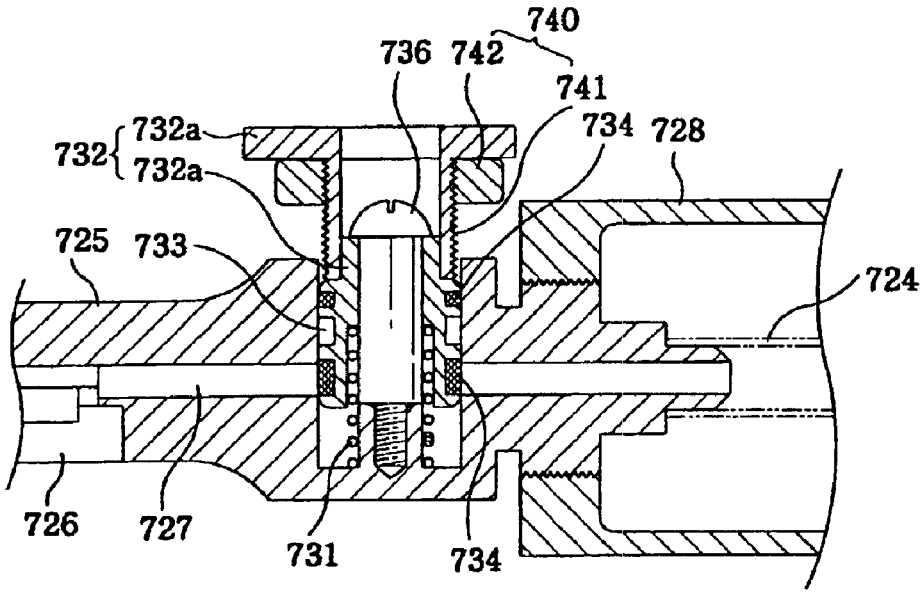
Figure 28:
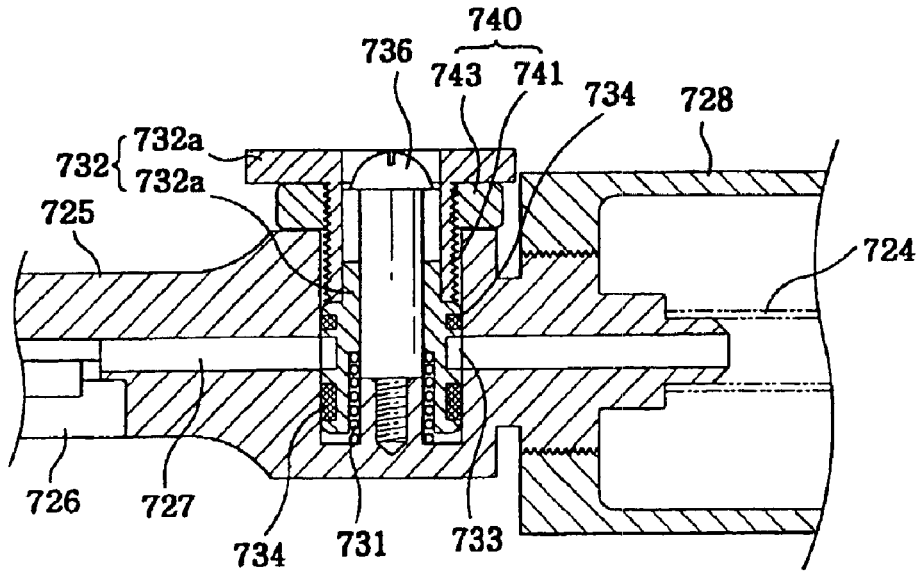

First, if the supplying button 732 of the hair setting material supplying device shown in FIG. 27 is not pressed, the carrying channel formed in the backbone 725 of which is blocked by the setting material supplying button 732. When the supplying button 732 is pressed and moved forward against the spring 731 as shown in FIG. 28, the circular passage 733 formed on the outer surface of the supplying button 732 opens the carrying channel 727 formed in the backbone 725, thereby supplying the setting material to the comb 720 through the carrying channel 727.

Figure 29:
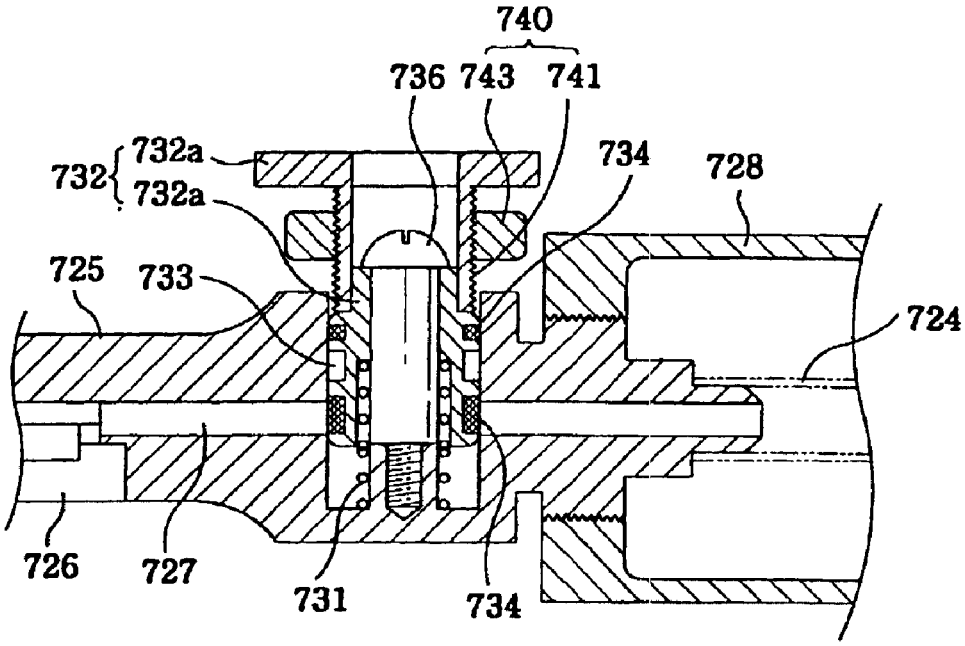

At this time, the feeding amount of the setting material supplied through the carrying channel 727 can be adjusted, if the operation distance of the supplying button 732 is adjusted by controlling the feeding amount controller 740, i.e., by moving inward the polygonal control nut 742 which is threadably engaged with the male screw 741 formed on the outer surface of the supplying button 732 as shown in FIG. 29.

Figure 30:
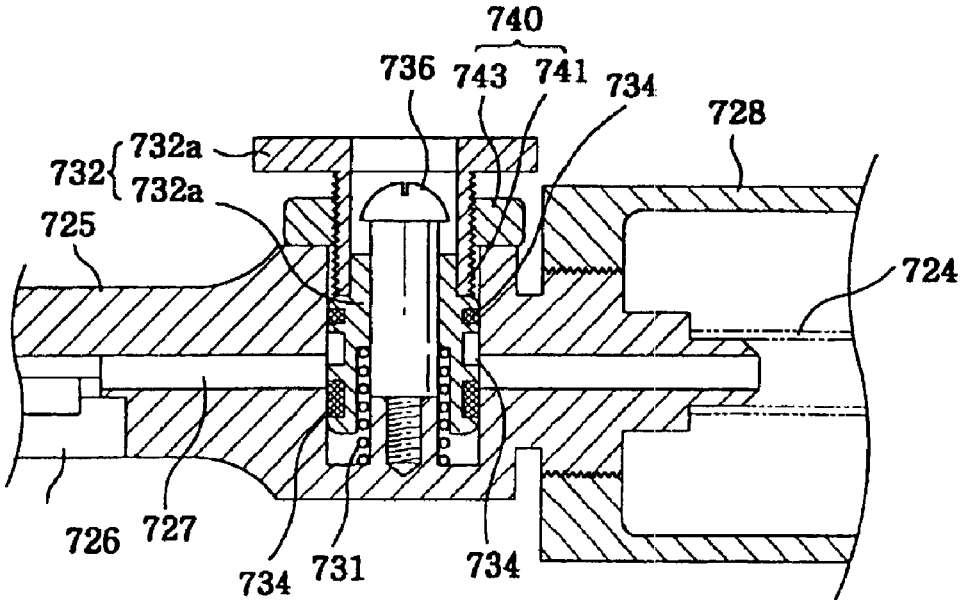

To be more specific, although the supplying button 732 is pressed by adjusting the control nut 742 inward as shown in FIG. 29, the supplying button 732 is not fully pressed since the control nut 742 is obstructed by the backbone 725 as shown in FIG. 30. Accordingly, the feeding amount of the setting material can be controlled since the circular passage 733 is partially communicated with the carrying channel 727 formed in the backbone 725.

Figure 31:
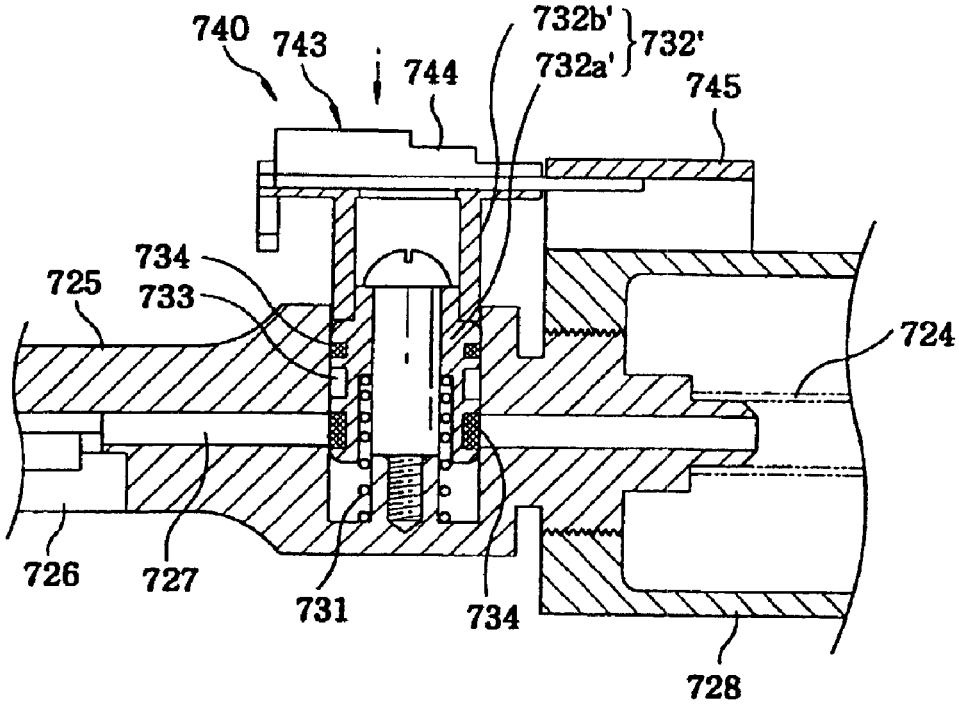

In the hair setting material supplying device in accordance with a modified seventh embodiment, if the pressuring member 743, which blocks the setting material carrying channel 727 formed in the backbone 725 as shown in FIG. 31, is pushed and slided in the direction of an arrow shown in FIG. 32, a stepped surface 744 comes into contact with the inner surface of the supporting member 745 so that the feeding amount of the setting material can be controlled.

In other words, the feeding amount of the setting material can be controlled as follows.

If the highest surface of the stepped surface 744 is contacted with the inner surface of the supporting member 745 as shown in FIG. 32, the circular passage formed on the outer surface of the supplying button 732 is entirely communicated with the carrying channel 727 and the feeding amount becomes maximum. And if the lowest surface of the stepped surface 744 is in contact with the inner surface of the supporting member 745 as shown in FIG. 33, the circular passage formed on the outer surface of the supplying button 732 is partially communicated with the carrying channel 727 and the feeding amount is decreased.

The supplying device in accordance with the preferred embodiment can be used comfortably without a continuous pressing of the supplying button 732'.

In the preferred embodiments, since the feeding amount of the setting material transferred from the setting material can to the comb can be controlled according to hair characteristics, it is possible to prevent the setting material from being wasted, which increases the setting efficiency and make the use of the setting material comfortable.

What is claimed is:

1. A hair setting device for setting hair to have a desired shape, comprising:

a setting material supply for storing hair setting material;

a hollow pipe-shaped body including a guide groove formed along a lengthwise direction of the body and a slit formed at a bottom of the guide groove, the slit communicating with an inside space of the hollow pipe-shaped body;

a base for fixing the hollow pipe-shaped body to the setting material supply, the base communicating with the inside space of the hollow pipe-shaped body and including an inner surface enclosing a nozzle of the setting material supply;

an operating valve including a setting material guide hole at a center portion of the operating valve, the operating valve being supported by a first spring inside the hollow pipe-shaped body, a bottom end portion of the operating valve being in contact with the nozzle of the setting material supply;

a push button installed at a bottom portion of the hollow pipe-shape body in a radial direction thereof and supported by a second spring, wherein the push button is in contact with the operating valve in such away that the operating valve is moved toward the nozzle of the setting material supply when the push button is pressed;

a comb including a base portion which is detachably engaged with the guide groove of the body and a plurality of outlets arranged in a regular interval for allowing the hair setting material to come out from the slit.

2. The hair setting device of claim 1, wherein the operating valve and the push button include an inclined surface, respectively, the inclined surface of the push button being slidably in contact with the inclined surface of the push button.

3. The hair setting device of claim 1, wherein an O-ring is provided at the interface between the operating valve and the setting material supply for maintaining air-tightness.

4. The hair setting device of claim 1, further comprising a plurality of combs including teeth having different lengths and intervals, respectively.

5. The hair setting device of claim 1, wherein the comb includes discharging guide grooves on teeth for reserving and guiding the discharged setting material to the end portion of the teeth.

6. A hair setting device comprising:

a hollow pipe-shaped body including a passage formed inside thereof, a guide groove formed along a lengthwise direction of the body, and a slit formed at a bottom of the guide groove and communicating with the passage;

a base provided at a bottom portion of the body for fixing the hollow pipe-shaped body to a setting material supply; and a comb including a base portion having a plurality of outlets formed in a regular interval, the base portion being detachably engaged with the guide groove, wherein the comb further includes engaging protrusions provided at both sides thereof and a rectangular-shaped control bar surrounding teeth of the comb, the rectangular-shaped control bar having positioning protrusions on an inner surface thereof, whereby lengths of the teeth can be adjusted by changing a position where the engaging protrusions engages with the positioning protrusions.

7. A hair setting device comprising:

a hollow pipe-shaped body including a passage formed inside thereof, a guide groove formed along a lengthwise direction of the body, and a slit formed at a bottom of the guide groove and communicating with the passage;

a base provided at a bottom portion of the body for fixing the hollow pipe-shaped body to a setting material supply; and a comb including a base portion having a plurality of outlets formed in a regular interval, the base portion being detachably engaged with the guide groove, wherein the comb further includes a control bar inserting slit have a predetermined depth from end portions of teeth of the comb and dividing the teeth into two parts, a control bar inserted into the control bar inserting slit, the control bar inserting silt having engaging protrusions on both inner side surfaces thereof and the control bar having positioning protrusions on both side surfaces thereof, whereby lengths of the teeth can be adjusted by changing a position where the engaging protrusions engage with the positioning protrusions.

8. A hair setting device comprising:

a hollow pipe-shaped body including a setting material passage formed inside thereof; a guide groove formed along a lengthwise direction of the body, and a slit formed at a bottom of the guide groove and communicating with the passage;

an operating valve installed at a bottom portion of the setting material passage, the operating valve including a through-hole through which setting material flows;

a push button provided at a bottom portion of the body in a radial direction, the push button being supported by a spring and in contact with a inclined surface of the operating valve in such a way that the operating valve moves downwards when the push button is pressed;

a comb including a base portion detachably engaged with the guide groove and a plurality of discharging holes disposed in a regular interval on the base portion;

a valve housing attached to a bottom portion of the body, the valve housing including an upper inner area and a lower inner area into which setting material flows, the upper inner area being communicated with the lower inner area;

a discharging nozzle provided in the upper inner area or the valve housing, the discharging nozzle including an end portion being in contact with the operating valve in such a way that the discharging valve can move in a vertical direction by the operation of the operating valve;

an adjustable valve disposed below the discharging valve, the adjustable valve being positioned by the discharging valve, wherein an entrance area between the upper inner area and the lower inner area is changed according to the position of the adjustable valve;

a baffle plate provided at the bottom of the valve housing for closing the lower inner area, the baffle plate a having setting material inlet;

a spring disposed between the adjustable valve and the baffle plate a for supporting the adjustable valve;

a hose including an end portion which is connected to the inlet of the baffle plate;

a motor pump to which the other end portion of the hose is connected; and a setting material conveying passage connecting the motor pump to the setting material supply.

9. The hair setting device of claim 8, wherein the discharging nozzle includes a revolution groove on an inner surface, wherein eddies are generated in a flow of the setting material.

10. The hair setting device of claim 8, wherein the discharging nozzle includes a plurality of setting material inlets at a bottom side portion thereof.

11. The hair setting device of claim 8, wherein the adjustable valve includes a rubber plate on a top surface for maintaining air-tightness between the upper inner area and the lower inner area.

12. The hair setting device of claim 8, further comprising a hose fixing cover for pressing and fixing the hose to the baffle plate.

13. The hair setting device of claim 8, further comprising an O-ring between the discharging nozzle and an inner surface of the lower inner area.

14. A hair setting material supplying device, comprising:

a setting material supply including a nozzle;

a hollow pipe-shaped grip member including a setting material passage, a valve button provided for opening and closing the setting material passage, a guide groove formed in a lengthwise direction of the grip member and a slit which is provided on an inner surface of the guide groove and communicating with the setting material passage;

a tube for connecting the hollow pipe-shaped grip member to the nozzle of the setting material supply;

a fixing member for fixing the tube to the nozzle and operating selectively to press the nozzle; and a comb including a base portion detachably engaged with the guide groove and a plurality of discharging holes.

15. The hair setting material supplying device of claim 14, wherein the nozzle of the hollow pipe-shaped grip member includes a nozzle pipe having a cylindrical shape and a nozzle center bar disposed in the nozzle pipe.

16. The hair setting material supplying device of claim 15, wherein the nozzle center bar includes a revolutionary groove or revolutionary protrusion so that eddies are generated in a flow of the setting material.

17. The hair setting material supplying device of claim 14, further comprising a case for accommodating the setting material supply and the comb, the case including a comb keeping box for accommodating a plurality of combs, a setting material supply supporter and a grip member keeping box.

18. The hair setting material supplying device of claim 17, wherein the setting material supply supporter has a circular hole formed on an upper portion of the case, a cylindrical supporting stand having an open upper portion through which the setting material supply is inserted, a flexible supporting means provided on the inner side of the cylindrical supporting stand so that various setting material supplies having different diameters can be supported thereby, a sphere-shaped joint fixed at a bottom portion of the cylindrical supporting stand and a joint support for holding the joint movable in the case.

19. A hair setting material supplying device, comprising:

a setting material supply including a nozzle;

a hollow pipe-shaped grip member including a setting material passage, a valve button provided for opening and closing the setting material passage, a guide groove formed in a lengthwise direction of the grip member and a guide groove formed in a lengthwise direction of the grip member and a slit which is provided on an inner surface of the guide groove and communicating with the setting material passage;

a tube for connecting the hollow pipe-shaped grip member to the nozzle of the setting material supply;

a fixing member for fixing the tube to the nozzle and operating selectively to press the nozzle;

a comb including a base portion detachably engaged with the guide groove and a plurality of discharging holes, wherein the comb further includes a reserving space provided in a base portion of the comb for reserving setting material conveyed from the setting material supply;

a plurality of discharging holes extending from the reserving space to areas between teeth of the comb or from the reserving space through each tooth of the comb to the side surface of said tooth; and an absorption member provided among teeth of the comb for absorbing the setting material discharged from discharging holes.

20. The hair setting material supplying device of claim 19, wherein the absorption member has a shape of sponge.

21. The hair setting material supplying device of claim 19, wherein the absorption member has a shape of brush.

22. The hair setting material supplying device of claim 21, wherein the tube accommodating space can be closed by a cover.

23. A hair setting device, comprising:

a setting material supplying unit including hair setting material and having a motor pump:

a hollow pipe-shaped grip member including a setting material passage, a valve button for opening and closing the setting material passage, a guide groove formed in a lengthwise direction of the grip member and a slit which is formed on an inner surface of the guide groove and communicating with the setting material passage; and a comb including a base portion detachably engaging with the guide groove and a plurality of discharging holes provided on the base portion.

24. The hair setting device of claim 23, wherein the motor pump is operated by a pressure difference.

25. The hair setting device of claim 23, wherein some amount of the setting material discharged from the motor pump is returned back to the motor pump.

26. The hair setting device of claim 23, wherein the hollow pipe-shaped grip member includes a tube accommodating space at bottom portion.

27. The hair setting device of claim 23, wherein the hollow pipe-shaped grip member includes a baffle member for preventing the setting material from flowing down.

* * * * *